US008440602B2

(12) United States Patent
Gonzales et al.

(10) Patent No.: US 8,440,602 B2
(45) Date of Patent: May 14, 2013

(54) LIQUID CLEANING AND/OR CLEANSING COMPOSITION COMPRISING A DIVINYL BENZENE CROSS-LINKED STYRENE POLYMER

(75) Inventors: Denis Alfred Gonzales, Brussels (BE); Martin Ian James, Cincinnati, OH (US); Geert Andre Deleersnyder, Wielsbeke (BE); Steve Ray Merrigan, West Chester, OH (US); Thomas Allen Desmarais, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 1 day.

(21) Appl. No.: 12/972,593

(22) Filed: Dec. 20, 2010

(65) Prior Publication Data

US 2011/0150949 A1 Jun. 23, 2011

Related U.S. Application Data

(60) Provisional application No. 61/288,887, filed on Dec. 22, 2009.

(51) Int. Cl.
*C11D 3/14* (2006.01)
*C11D 3/37* (2006.01)

(52) U.S. Cl.
USPC ..... 510/268; 510/130; 510/132; 510/139; 510/368; 510/369; 510/395; 510/397

(58) Field of Classification Search ..... 510/130, 510/132, 139, 268, 368, 369, 395, 397
See application file for complete search history.

(56) References Cited

U.S. PATENT DOCUMENTS

| | | | | |
|---|---|---|---|---|
| 1,621,906 | A | 3/1927 | Schless | |
| 2,082,275 | A | 6/1937 | Daimler et al. | |
| 2,084,632 | A | 6/1937 | Ellis | |
| 2,255,082 | A | 9/1941 | Orthner et al. | |
| 2,438,091 | A | 3/1948 | Lynch | |
| 2,528,378 | A | 10/1950 | Mannheimer | |
| 2,658,072 | A | 11/1953 | Kosmin | |
| 2,702,279 | A | 2/1955 | Funderburk et al. | |
| 3,070,510 | A | 12/1962 | Cooley et al. | |
| 3,586,715 | A | 6/1971 | Smeets | |
| 3,812,044 | A | 5/1974 | Connor et al. | |
| 3,915,903 | A | 10/1975 | Wise | |
| 3,929,678 | A | 12/1975 | Laughlin et al. | |
| 3,985,668 | A | 10/1976 | Hartman | |
| 4,025,444 | A | 5/1977 | Murphy et al. | |
| 4,051,056 | A | 9/1977 | Hartman | |
| 4,088,620 | A | 5/1978 | Nihongi et al. | |
| 4,102,992 | A | 7/1978 | Davis | |
| 4,240,919 | A | 12/1980 | Chapman | |
| 4,298,490 | A | 11/1981 | Lange et al. | |
| 4,309,316 | A | 1/1982 | Lange et al. | |
| 4,473,611 | A * | 9/1984 | Haq | 428/198 |
| 4,481,126 | A | 11/1984 | Trinh et al. | |
| 4,537,604 | A | 8/1985 | Dawson | |
| 4,565,644 | A | 1/1986 | Smith et al. | |
| 4,565,647 | A | 1/1986 | Llenado | |
| 4,581,385 | A | 4/1986 | Smith et al. | |
| 4,657,692 | A | 4/1987 | Choy et al. | |
| 4,663,069 | A | 5/1987 | Llenado | |
| 4,676,920 | A | 6/1987 | Culshaw | |
| 4,704,233 | A | 11/1987 | Hartman et al. | |
| 4,767,563 | A | 8/1988 | De Buzzaccarini | |
| 4,772,425 | A | 9/1988 | Chirash et al. | |
| 4,842,763 | A | 6/1989 | Troger et al. | |
| 4,906,396 | A | 3/1990 | Falholt et al. | |
| 5,287,207 | A | 2/1994 | Mulkens et al. | |
| 5,500,451 | A | 3/1996 | Goldman et al. | |
| 5,776,872 | A | 7/1998 | Giret et al. | |
| 5,776,878 | A | 7/1998 | Theon | |
| 5,798,505 | A | 8/1998 | Lee | |
| 5,821,214 | A | 10/1998 | Weibel | |
| 5,830,445 | A | 11/1998 | Bouillon et al. | |
| 5,883,062 | A | 3/1999 | Addison et al. | |
| 5,898,026 | A | 4/1999 | Yianakopoulos et al. | |
| 5,906,973 | A | 5/1999 | Ouzounis et al. | |
| 6,008,181 | A | 12/1999 | Cripe et al. | |
| 6,020,303 | A | 2/2000 | Cripe et al. | |
| 6,060,443 | A | 5/2000 | Cripe et al. | |
| 6,080,707 | A | 6/2000 | Glenn et al. | |
| 6,132,212 | A | 10/2000 | Horiguchi et al. | |
| 6,221,829 | B1 | 4/2001 | Symes et al. | |
| 6,242,405 | B1 | 6/2001 | Lykke et al. | |
| 6,265,363 | B1 | 7/2001 | Viscovitz | |
| 6,268,325 | B1 | 7/2001 | Luciani et al. | |
| 6,274,540 | B1 | 8/2001 | Scheibel et al. | |
| 6,299,746 | B1 | 10/2001 | Conte et al. | |
| 6,306,817 | B1 | 10/2001 | Kott et al. | |
| 6,330,916 | B1 * | 12/2001 | Rickards et al. | 166/280.2 |
| 6,359,031 | B1 | 3/2002 | Lykke et al. | |
| 6,369,121 | B1 | 4/2002 | Catalfamo et al. | |
| 6,444,716 | B1 | 9/2002 | Hird et al. | |
| 6,514,926 | B1 | 2/2003 | Kott et al. | |
| 6,525,233 | B1 | 2/2003 | Connor et al. | |
| 6,537,957 | B1 | 3/2003 | Cardola et al. | |

(Continued)

FOREIGN PATENT DOCUMENTS

| | | | |
|---|---|---|---|
| DE | 24 10 425 | A1 | 10/1974 |
| DE | 10 2004 038771 | A1 | 8/2005 |

(Continued)

OTHER PUBLICATIONS

International Search Report; International Application No. PCT/US2010/061204; mailed Apr. 15, 2011; 9 pages.

(Continued)

*Primary Examiner* — Charles Boyer
(74) *Attorney, Agent, or Firm* — John T. Dipre; Steven W. Miller

(57) ABSTRACT

The present invention relates to a liquid, cleaning and/or cleansing composition comprising abrasive cleaning particles, wherein said abrasive cleaning particles comprise a divinyl benzene cross-linked styrene polymer, wherein said abrasive cleaning particles are non-spherical and have a mean particles size D(v,0.9) of at least about 10 μm and wherein said liquid, cleaning and/or cleansing composition comprises from about 0% to about 30% by weight of the composition of an organic solvent.

24 Claims, 2 Drawing Sheets

U.S. PATENT DOCUMENTS

| | | | | |
|---|---|---|---|---|
| 6,566,319 | B1 | 5/2003 | Scheibel et al. | |
| 6,583,096 | B1 | 6/2003 | Kott et al. | |
| 6,593,285 | B1 | 7/2003 | Scheibel et al. | |
| 6,602,840 | B1 | 8/2003 | Scheibel et al. | |
| 6,699,963 | B2 | 3/2004 | Noda et al. | |
| 6,749,066 | B2 | 6/2004 | Bergman | |
| 6,759,377 | B2 | 7/2004 | Hackenthal et al. | |
| 6,767,878 | B1 | 7/2004 | Paye et al. | |
| 6,808,759 | B1 | 10/2004 | Okumura et al. | |
| 6,858,216 | B2 * | 2/2005 | Schulze zur Wiesche et al. | 424/401 |
| 7,307,055 | B2 | 12/2007 | Cook et al. | |
| 7,393,820 | B2 | 7/2008 | Soldanski et al. | |
| 7,713,921 | B2 | 5/2010 | Boutique et al. | |
| 7,994,111 | B2 | 8/2011 | Caggioni et al. | |
| 2002/0137647 | A1 | 9/2002 | Hackenthal et al. | |
| 2002/0166832 | A1 | 11/2002 | Silud et al. | |
| 2002/0173243 | A1 | 11/2002 | Costas et al. | |
| 2003/0176633 | A1 * | 9/2003 | Noda et al. | 528/480 |
| 2003/0215417 | A1 | 11/2003 | Uchiyama et al. | |
| 2004/0216388 | A1 | 11/2004 | Mathur et al. | |
| 2004/0266645 | A1 | 12/2004 | Albrecht et al. | |
| 2005/0065056 | A1 | 3/2005 | Cook et al. | |
| 2005/0130873 | A1 | 6/2005 | Cheung et al. | |
| 2005/0170979 | A1 | 8/2005 | Massaro et al. | |
| 2005/0201965 | A1 | 9/2005 | Kuhlman et al. | |
| 2006/0011885 | A1 | 1/2006 | Christmas et al. | |
| 2006/0094635 | A1 | 5/2006 | Pereira | |
| 2006/0177488 | A1 | 8/2006 | Caruso et al. | |
| 2007/0006391 | A1 | 1/2007 | Ghosh et al. | |
| 2007/0010415 | A1 | 1/2007 | Kinscherf et al. | |
| 2007/0041927 | A1 | 2/2007 | Blaeser et al. | |
| 2007/0043147 | A1 | 2/2007 | Higgins et al. | |
| 2007/0135645 | A1 | 6/2007 | Ignatyev et al. | |
| 2007/0138671 | A1 | 6/2007 | Anastasiou et al. | |
| 2007/0167345 | A1 | 7/2007 | Soldanski et al. | |
| 2007/0191256 | A1 | 8/2007 | Fossum et al. | |
| 2007/0270730 | A1 | 11/2007 | Rische et al. | |
| 2008/0108714 | A1 | 5/2008 | Swazey et al. | |
| 2008/0139702 | A1 | 6/2008 | De Almeida et al. | |
| 2008/0149137 | A1 | 6/2008 | Steinbrenner et al. | |
| 2008/0248144 | A1 | 10/2008 | Guenter et al. | |
| 2009/0176935 | A1 | 7/2009 | Boeckh et al. | |
| 2009/0253816 | A1 | 10/2009 | Nascimento et al. | |
| 2009/0291306 | A1 | 11/2009 | Quadbeck-Seeger | |
| 2009/0325837 | A1 | 12/2009 | Mundschau et al. | |
| 2010/0081604 | A1 | 4/2010 | Barger et al. | |
| 2010/0081605 | A1 | 4/2010 | Barger et al. | |
| 2010/0081606 | A1 | 4/2010 | Barger et al. | |
| 2010/0197553 | A1 | 8/2010 | Barnabas et al. | |
| 2011/0021398 | A1 | 1/2011 | Allef et al. | |
| 2011/0039744 | A1 | 2/2011 | Heath et al. | |
| 2011/0150787 | A1 | 6/2011 | Gonzales et al. | |
| 2011/0150788 | A1 | 6/2011 | Gonzales et al. | |
| 2011/0150950 | A1 | 6/2011 | Gonzales et al. | |
| 2011/0150951 | A1 | 6/2011 | Gonzales et al. | |
| 2011/0178196 | A1 | 7/2011 | Steinke et al. | |
| 2011/0189414 | A1 | 8/2011 | Whitehouse | |
| 2011/0262371 | A1 | 10/2011 | Deleersnyder et al. | |
| 2011/0262504 | A1 | 10/2011 | Deleersnyder et al. | |
| 2011/0287105 | A1 | 11/2011 | Gittleman | |
| 2012/0029519 | A1 | 2/2012 | Sengun et al. | |
| 2012/0066851 | A1 | 3/2012 | Gonzales et al. | |
| 2012/0071378 | A1 | 3/2012 | Gonzales et al. | |
| 2012/0071379 | A1 | 3/2012 | Gonzales et al. | |
| 2012/0071380 | A1 | 3/2012 | Gonzales et al. | |
| 2012/0071383 | A1 | 3/2012 | Perez-Prat Vinuesa et al. | |
| 2012/0202730 | A1 | 8/2012 | Allef et al. | |

FOREIGN PATENT DOCUMENTS

| | | | |
|---|---|---|---|
| DE | 10 2005 023801 | A1 | 11/2006 |
| EP | 0 226 723 | A2 | 7/1987 |
| EP | 0 957 156 | A1 | 11/1999 |
| EP | 1 136 063 | A2 | 9/2001 |
| EP | 1 460 125 | A1 | 9/2004 |
| GB | 2 001 099 | A | 1/1979 |
| GB | 2 126 999 | A | 4/1984 |
| GB | 2 145 729 | A | 4/1985 |
| GB | 2 184 454 | A | 6/1987 |
| JP | 59192526 | A | 10/1984 |
| JP | 10025239 | A | 1/1998 |
| JP | 2005 296822 | A | 10/2005 |
| JP | 2007 077311 | A | 3/2007 |
| JP | 2009 160717 | A | 7/2009 |
| WO | WO 91/14420 | A1 | 10/1991 |
| WO | WO 99/05084 | A1 | 2/1999 |
| WO | WO 99/52500 | A1 | 10/1999 |
| WO | WO 01/09279 | A1 | 2/2001 |
| WO | WO 01/30315 | A1 | 5/2001 |
| WO | WO 01/31110 | A1 | 5/2001 |
| WO | WO 02/38720 | A1 | 5/2002 |
| WO | WO 03/043599 | A1 | 5/2003 |
| WO | WO 2004/071483 | A1 | 8/2004 |
| WO | WO 2004/083328 | A2 | 9/2004 |
| WO | WO 2008/006736 | A1 | 1/2008 |
| WO | WO 2008/109270 | A1 | 9/2008 |

OTHER PUBLICATIONS

U.S. Appl. No. 13/517,837, filed Jun. 14, 2012, Gonzales, et al.
U.S. Appl. No. 13/517,728, filed Jun. 14, 2012, Gonzales, et al.
U.S. Appl. No. 13/526,592, filed Jun. 19, 2012, Gonzales, et al.
U.S. Appl. No. 13/526,596, filed Jun. 19, 2012, Gonzales, et al.
U.S. Appl. No. 13/517,746, filed Jun. 14, 2012, Gonzales, et al.
U.S. Appl. No. 13/526,605, filed Jun. 19, 2012, Gonzales, et al.
U.S. Appl. No. 13/526,613, filed Jun. 19, 2012, Gonzales, et al.
U.S. Appl. No. 13/517,762, filed Jun. 14, 2012, Perez-Prat Vinuesa, et al.
U.S. Appl. No. 13/621,858, filed Sep. 18, 2012, Gonzales, et al.
U.S. Appl. No. 13/621,860, filed Sep. 18, 2012, Perez-Prat Vinuesa, et al.
ASTM Designation: F1877-05 Jun. 10, 2009; Standard Practice for Characterization of Particles; 14 pages; chapter 11.3.6; Section 11.3.2.
International Standard; ISO 9276-6:2008(E) section 8.2; section 7; Representation of results of particle size analysis—Part 6: Descriptive and quantitative representation of particle shape and morphology.
"Vegetable Ivory", W.P. Armstrong, (http://waynesword.palomar.edu/pljan99.htm).
"Phytelephas", Wikipedia.org (http://en.wikipedia.org/wild/Phytelephas).

* cited by examiner

LIQUID CLEANING AND/OR CLEANSING COMPOSITION COMPRISING A DIVINYL BENZENE CROSS-LINKED STYRENE POLYMER

CROSS REFERENCE TO RELATED APPLICATION

This application claims the benefit of U.S. Provisional Application No. 61/288,887, filed Dec. 22, 2009.

TECHNICAL FIELD

The present invention relates to liquid compositions for cleaning and/or cleansing a variety of inanimate and animate surfaces, including hard surfaces in and around the house, dish surfaces, hard and soft tissue surface of the oral cavity, such as teeth, gums, tongue and buccal surfaces, fabrics, human and animal skin etc. More specifically, the present invention relates to liquid scouring composition comprising particles suitable for cleaning and/or cleansing.

BACKGROUND OF THE INVENTION

Scouring compositions such as particulate compositions or liquid (incl. gel, paste-type) compositions containing abrasive components are well known in the art. Such compositions are used for cleaning and/or cleansing a variety of surfaces, especially those surfaces that tend to become soiled with difficult to remove stains and soils.

Amongst the currently known scouring compositions, the most popular ones are based on abrasive particles with shapes varying from spherical to irregular. The most common abrasive particles are either inorganic like carbonate salt, clay, silica, silicate, shale ash, perlite and quartz sand or organic polymers beads like polypropylene, PVC, Melamine, polyacrylate and derivatives, and come in the form of liquid composition having a creamy consistency with the abrasive particles suspended therein.

The surface safety profile of such currently known scouring compositions is inadequate alternatively, poor cleaning performances is shown for compositions with an adequate surface safety profile. Indeed, due to the presence of very hard abrasive particles, these compositions can damage, i.e., scratch the surfaces onto which they have been applied. Indeed, the formulator needs to choose between good cleaning/cleansing performance but featuring strong surface damage or compromising on the cleaning/cleansing performance while featuring acceptable surface safety profile. In addition, such currently known scouring compositions at least in certain fields of application (e.g., hard surface cleaning) are perceived by consumers as outdated.

It is thus an objective of the present invention to provide a liquid cleaning and/or cleansing composition comprising particles suitable to clean/cleanse a variety of surfaces, including inanimate and animate surfaces, such hard surfaces in and around the house, dish surfaces, hard and soft tissue surface of the oral cavity, such as teeth, gums, tongue and buccal surfaces, fabrics, human and animal skin etc., wherein the composition provides good cleaning/cleansing performance, whilst providing a good surface safety profile.

It has been found that the above objective can be met by the compositions according to the present invention.

It is an advantage of the compositions according to the present invention that they may be used to clean/cleanse inanimate and animate surfaces made of a variety of materials like glazed and non-glazed ceramic tiles, enamel, stainless steel, Inox®, Formica®, vinyl, no-wax vinyl, linoleum, melamine, glass, plastics, human and animal skin, hair, hard and soft tissue surface of the oral cavity, such as teeth, gums, tongue and buccal surfaces enamel and the like.

A further advantage of the present invention is that in the compositions herein, the particles can be formulated at very low levels, whilst still providing the above benefits. Indeed, in general for other technologies, high levels of abrasive particles are needed to reach good cleaning/cleansing performance, thus leading to high formulation and process costs, difficult rinse and end cleaning profiles, as well as limitation for aesthetics of the cleaning/cleansing composition.

SUMMARY OF THE INVENTION

The present invention relates to a liquid, cleaning and/or cleansing composition comprising abrasive cleaning particles, wherein said abrasive cleaning particles comprise a divinyl benzene cross-linked styrene polymer, wherein said abrasive cleaning particles are non-spherical and have a mean particle size D(v,0.9) of at least about 10 μm and wherein said liquid, cleaning and/or cleansing composition comprises from about 0% to about 30% by weight of the composition of an organic solvent.

The present invention further encompasses a method of cleaning and/or cleansing a surface with a liquid, cleaning and/or cleansing composition comprising abrasive cleaning particles according to any of the preceding claims, wherein said surface is contacted with said composition, preferably wherein said composition is applied onto said surface.

DETAILED DESCRIPTION OF THE INVENTION

The Liquid Cleaning/Cleansing Composition

Figure 1:
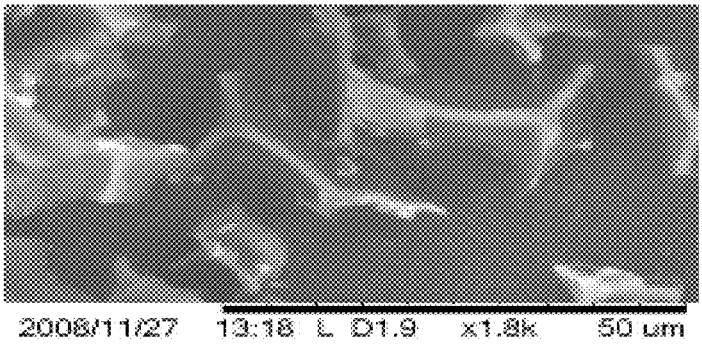
FIG. 1 is an electron microscopy image showing abrasive cleaning particles according to the present invention.

The compositions according to the present invention are designed as cleaners/cleansers for a variety of inanimate and animate surfaces. Preferably, the compositions herein are suitable for cleaning/cleansing surfaces selected from the group consisting of: inanimate surfaces, animate surfaces.

In a preferred embodiment, the compositions herein are suitable for cleaning/cleansing inanimate surfaces selected from the group consisting of: household hard surfaces; dish surfaces; fabric surfaces, especially leather or synthetic leather; and automotive vehicle surfaces.

In a highly preferred embodiment herein, the compositions herein are suitable for cleaning household hard surfaces.

By "household hard surface", it is meant herein any kind of surface typically found in and around houses like kitchens, bathrooms, e.g., floors, walls, tiles, windows, cupboards, sinks, showers, shower plastified curtains, wash basins, WCs, fixtures and fittings and the like made of different materials like ceramic, vinyl, no-wax vinyl, linoleum, melamine, glass, Inox®, Formica®, any plastics, plastified wood, metal or any painted or varnished or sealed surface and the like. Household hard surfaces also include household appliances including, but not limited to refrigerators, freezers, washing machines, automatic dryers, ovens, microwave ovens, dishwashers and so on. Such hard surfaces may be found both in private households as well as in commercial, institutional and industrial environments.

By "dish surfaces" it is meant herein any kind of surfaces found in dish cleaning, such as dishes, cutlery, cutting boards, pans, and the like. Such dish surfaces may be found both in private households as well as in commercial, institutional and industrial environments.

In another preferred embodiment, the compositions herein are suitable for cleaning/cleansing animate surfaces selected from the group consisting of: human skin; animal skin; human hair; animal hair; and hard and soft tissue surface of the oral cavity, such as teeth, gums, tongue and buccal surfaces.

The compositions according to the present invention are liquid compositions as opposed to a solid or a gas. Liquid compositions include compositions having a water-like viscosity as well as thickened compositions, such as gels and pastes.

In a preferred embodiment herein, the liquid compositions herein are aqueous compositions. Therefore, they may comprise from about 65% to about 99.5% by weight of the total composition of water, preferably from about 75% to about 98% and more preferably from about 80% to about 95%.

In another preferred embodiment herein, the liquid compositions herein are non-aqueous compositions. Therefore, they may comprise from about 0% to about 10% by weight of the total composition of water, preferably from about 0% to about 5%, more preferably from about 0% to about 1% and most preferably about 0%.

The compositions of the present invention may have a pH, as is measured at 25° C., from about 0 to about 14.

In a preferred embodiment herein, the compositions herein are acidic to neutral compositions, preferably acidic compositions, and thus have a pH, as is measured at 25° C., of about 0-7, more preferably about 0-6, even more preferably about 0.5-5.

In another preferred embodiment herein, the compositions herein are neutral to alkaline compositions, preferably alkaline compositions, and thus have a pH, as is measured at 25° C., of about 7-14, more preferably about 8-12, even more preferably about 9-11.

In yet another preferred embodiment herein, the compositions herein are neutral compositions, and thus have a pH, as is measured at 25° C., of about 6-8, more preferably about 6.5-7.5, even more preferably about 7.

Accordingly, the compositions herein may comprise a base to adjust the pH.

A suitable base to be used herein is an organic and/or inorganic base. Suitable bases for use herein are the caustic alkalis, such as sodium hydroxide, potassium hydroxide and/or lithium hydroxide, and/or the alkali metal oxides such, as sodium and/or potassium oxide or mixtures thereof. A preferred base is a caustic alkali, more preferably sodium hydroxide and/or potassium hydroxide.

Other suitable bases include ammonia, ammonium carbonate, all available carbonate salts such as $K_2CO_3$, $Na_2CO_3$, $Ca_2CO_3$, $Mg_2CO_3$, etc., alkanolamines (as e.g. monoethanolamine), urea and urea derivatives, polyamine, etc.

Typical levels of such bases, when present, are of from about 0.01% to about 5.0%, preferably from about 0.05% to about 3.0% and more preferably from about 0.1% to about 0.6% by weight of the total composition.

The compositions herein may comprise an acid to trim its pH to the required level, despite the presence of an acid, if any, the compositions herein will maintain their neutral pH as described herein above. A suitable acid for use herein is an organic and/or an inorganic acid. A preferred organic acid for use herein has a pKa of less than 6. A suitable organic acid is selected from the group consisting of citric acid, lactic acid, glycolic acid, succinic acid, glutaric acid and adipic acid and a mixture thereof. A mixture of said acids may be commercially available from BASF under the trade name Sokalan® DCS. A suitable inorganic acid is selected from the group consisting hydrochloric acid, sulphuric acid, phosphoric acid and a mixture thereof.

A typical level of such an acid, when present, is of from about 0.01% to about 5.0%, preferably from about 0.04% to about 3.0% and more preferably from about 0.05% to about 1.5% by weight of the total composition.

In a preferred embodiment according to the present invention the compositions herein are thickened compositions. Preferably, the liquid compositions herein have a viscosity of up to about 5000 cps at 20 $s^{-1}$, more preferably from about 50 cps to about 5000 cps, yet more preferably from about 50 cps to about 2000 cps and most preferably from about 50 cps to about 1200 cps at 20 $s^{-1}$ and 20° C. when measured with a Rheometer, model AR 1000 (Supplied by TA Instruments) with a 4 cm conic spindle in stainless steel, 2° angle (linear increment from 0.1 to 100 $sec^{-1}$ in max. 8 minutes).

In another preferred embodiment according to the present invention the compositions herein have a water-like viscosity. By "water-like viscosity" it is meant herein a viscosity that is close to that of water. Preferably the liquid compositions herein have a viscosity of up to about 50 cps at 60 rpm, more preferably from about 0 cps to about 30 cps, yet more preferably from about 0 cps to about 20 cps and most preferably from about 0 cps to 1 about 0 cps at 60 rpm and 20° C. when measured with a Brookfield digital viscometer model DV II, with spindle 2.

Abrasive Cleaning Particles

The liquid, cleaning and/or cleansing composition herein comprise abrasive cleaning particles.

It has surprisingly been found that the abrasive cleaning particles of the present invention show a good cleaning performance even at relatively low levels, such as preferably from about 0.1% to about 20%, preferably from about 0.1% to about 10%, more preferably from about 0.5% to about 5%, even more preferably from about 0.5% to about 2%, by weight of the total composition of said abrasive cleaning particles.

The abrasive cleaning particles herein are non-spherical.

By "non spherical" it is meant herein, having a shape different from a sphere and having a Form Factor (FF) of below about 0.75.

Preferably, the abrasive cleaning particles herein have a Form Factor (FF) of below about 0.6, most preferably below about 0.50.

By "Form Factor (FF)" it is meant herein a dimensional indicator that defines how a given particle is different from a regular form of a sphere especially emphasizing irregular surface topology (e.g., Surface roughness) as defined by ASTM F1877-05 (June 2009) chapter 11.3.6, wherein: $FF=4*\pi*\text{Surface Area}+\text{Perimeter}^2$; with "Surface Area" meaning the surface area (in $\mu m^2$) of a particle and "Perimeter" the distance (in μm) around the cross-section of the particle that contains the longest axis.

In a preferred embodiment the abrasive cleaning particles are preferably non-rolling. Alternatively in another preferred embodiment the abrasive cleaning particles are preferably sharp. By "non-rolling" is meant that the abrasive cleaning particle and the surface are in contact with each other by sliding. The applicant has found that non-rolling and sharp abrasive cleaning particles provide good soil removal and low surface damage. Indeed the applicant has found that very specific particle shapes, e.g., defined by circularity promote effective sliding of the abrasive particles vs. typical abrasive particles, where rolling movement is rather promoted and is less effective as displacing soil from the surface. The circularity to meet the criteria, to promote effective sliding of the particles is of from about 0.1 to about 0.45.

Indeed the applicant has found that non-rolling and/or sharp abrasive cleaning particles provide good soil removal.

Circularity is a quantitative, 2-dimension image analysis shape description and is being measured according to ISO 9276-6:2008(E) section 8.2 as implemented via the Occhio Nano 500 Particle Characterisation Instrument with its accompanying software Callistro version 25 (Occhio s.a. Liege, Belgium). Circularity is a preferred mesoshape descriptor and is widely available in shape analysis instrument such as in Occhio Nano 500 or in Malvern Morphologi G3. Circularity is sometimes described in literature as being the difference between a particle's shape and a perfect sphere. Circularity values range from 0 to 1, where a circularity of 1 describes a perfectly spherical particles or disc particle as measured in a two dimensional image.

$$C = \sqrt{\frac{4\pi A}{P^2}}$$

Where A is projection area, which is 2D descriptor and P is the length of the perimeter of the particle.

The applicant has found that the abrasive cleaning particles having a mean circularity from about 0.1 to about 0.45, preferably from about 0.15 to about 0.40 and more preferably from about 0.2 to about 0.35 are providing improved cleaning performance and surface safety. Mean data are extracted from volume-based vs. number-based measurements. Thus, preferably, the non-spherical particles herein have a mean circularity from about 0.1 to about 0.45, preferably from about 0.15 to about 0.40 and more preferably from about 0.2 to about 0.35.

By the term "mean circularity", it is mean herein the average of the circularity values of each particle taken from a population of at least about 10 000 particles, preferably above about 50 000 particles, more preferably above about 100 000 particles, after excluding from the measurement and calculation, the circularity data of particles having a particle size of below about 10 microns.

The non-spherical particles herein preferably have sharp edges ("sharp") and each particle has at least one edge or surface having concave curvature. More preferably, the non-spherical particles herein have a multitude of sharp edges and each particle has at least one edge or surface having concave curvature. The sharp edges of the non-spherical particles are defined by the edge having an edge tip radius below about 8 μm, preferably below about 5 μm, most preferably below about 3 μm. The edge tip radius is defined by the radius of an imaginary circle fitting the curvature of the edge extremity.

Figure 3:
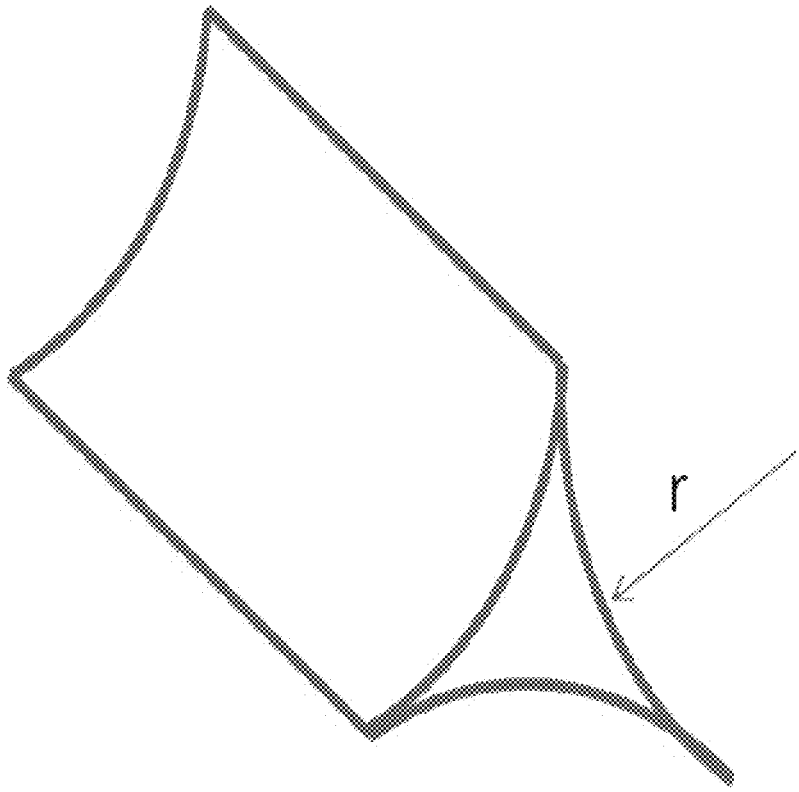
FIG. 3 is a schematic showing a particles surface having a concave curvature, wherein the radius (r) of said curvature is centered outside the bulk of the particle.
Figure 4:
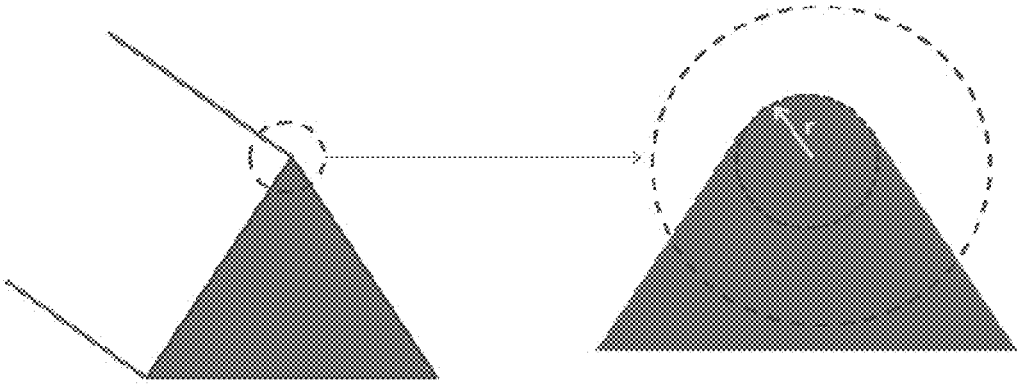
FIG. 4 is a schematic showing a particle's edge tip radius.

FIG. 3 is a schematic showing a particles surface having a concave curvature, wherein the radius (r) of said curvature is centered outside the bulk of the particle. FIG. 4 is a schematic showing a particle's edge tip radius.

Figure 2:
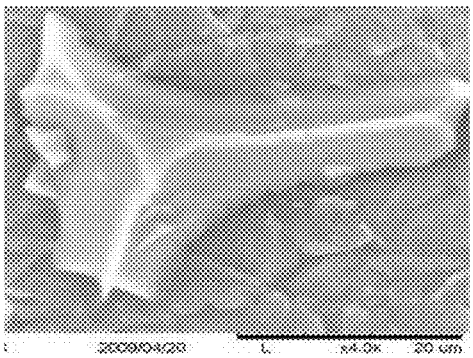
FIG. 2 is an electron microscopy image showing an abrasive cleaning particle according to the present invention.

FIG. 1 and FIG. 2 herein show abrasive cleaning particles with a Form Factor of below 0.75 and an edge tip radius below 5 μm.

The abrasive cleaning particles have a mean particles size D(v,0.9) of at least about 10 μm.

By "mean particles size D(v,0.9) of at least about 10 μm" for a particle size distribution it is meant that 90% of the particles (expressed in volume unit) have a size of at least about 10 μm. The Particle Size Distribution analysis is performed using a standard laser diffraction instrument (e.g., Mastersizer series from Malvern) accordingly to ISO13320 standard (2009 revision).

In a preferred embodiment, the abrasive cleaning particles have a mean particle size D(v,0.9) of from about 10 μm to about 1000 μm, preferably from about 10 μm to about 100 μm, more preferably from about 10 μm to about 50 μm.

In a preferred embodiment herein, the abrasive cleaning particles have a mean Equivalent Circle Diameter ECD of at least about 10 μm.

The abrasive particles have a size defined by their area-equivalent diameter (ISO 9276-6:2008(E) section 7) also called Equivalent Circle Diameter ECD (ASTM F1877-05 Section 11.3.2). The mean ECD of particle population is calculated as the average of respective ECD of each particles of a particle population of at least 10 000 particles, preferably above 50 000 particles, more preferably above 100 000 particles after excluding from the measurement and calculation the data of particles having area-equivalent diameter (ECD) of below 10 microns. The mean data is extracted from volume-based vs. number-based measurements.

In this preferred embodiment, the abrasive cleaning particles have preferably a mean ECD from about 10 μm to about 1000 μm, preferably from about 50 μm to about 500 μm, more preferably from about 100 μm to about 350 μm and most preferably from about 150 to about 250 μm.

The abrasive particle size is also critical to achieve efficient cleaning performance whereas excessively abrasive population with small particle sizes, e.g., typically below 10 microns feature polishing action vs. cleaning despite featuring a high number of particles per particle load in cleaner/cleanser inherent to the small particle size. On the other hand, an abrasive population with excessively high particle size, e.g., typically above 1000 microns, delivers not optimal cleaning efficiency since the number of particles per particle load in cleaner decreases significantly inherently to the large particle size. Additionally, excessively small particle size are not desirable in cleaner/for cleaning task since in practice, small and numerous particles are often hard to remove from the various surface topologies which requires excessive effort to remove from the user unless leaving the surface with visible particles residue. On the other hand, excessively large particle are too easily detected visually or provide bad tactile experience while handling or using the cleaner. Therefore, the applicants define herein an optimal particle size range that deliver both optimal cleaning performance and usage experience.

The abrasive cleaning particles herein comprise a covalently cross-linked copolymer of styrene-co-divinyl benzene.

In a preferred embodiment herein, said abrasive cleaning particles comprise about 100% by weight of the total particle of the styrene-co-divinyl benzene copolymer.

In another preferred embodiment herein, said abrasive cleaning particles comprise about 10 to about 80% by weight of the total particle of the styrene-co-divinyl benzene copolymer. In this preferred embodiment, said abrasive cleaning particles comprises an auxiliary material or a mixture thereof.

Covalently Cross-Linked Copolymer of Styrene-Co-Divinyl Benzene and Particles Therefrom The abrasive cleaning particles herein comprise a covalently cross-linked copolymer of styrene-co-divinyl benzene.

By "covalently cross-linked copolymer of styrene-co-divinyl benzene" it is meant herein a copolymer comprising mono-functional and multi-functional monomeric units preferably di-functional monomeric units, all derived from the vinyl benzene structure, copolymerized to form a covalently cross-linked network structure.

The "principal monomeric components" of the copolymer are styrene, various structural isomers (ortho, meta, para substituted) of divinyl benzene and various structural isomers (ortho, meta, para substituted) of ethyl, as well as vinyl benzene. The latter is a by-product of the manufacture of divinyl benzene, present in varying amounts depending on the supply source. Divinyl benzene provides covalent cross-links in the network structure via incorporation of each of its polymerizable vinyl groups into different propagating polymer chains. For a formulation comprising equal parts of Styrene to DVB 55 (a mixture of divinyl benzene and ethyl vinyl benzene in the weight ratio of 55:45, commercially available from the Dow Chemical Co.) there is approximately one difunctional monomer for every three monofunctional monomers. Alternatively, monomers based on chemical structures bearing styrene or divinyl benzene type of chemical structures can also be prepared alone or copolymerized with styrene or divinyl benzene into abrasive particles.

Other suitable divinyl benzene cross-linked styrene polymers include copolymers of styrene and divinyl benzene as well as at least one additional monomeric unit, such as alkyl vinyl benzenes, for example ethyl styrene, or alkyl esters of acrylic or methacrylic acid and mixtures thereof.

Preferred covalently cross-linked copolymers of styrene-co-divinyl benzene comprise about 20% to about 80%, preferably about 40% to about 60%, of styrene and the balance of divinyl benzene and ethyl styrene in the weight ratio of 55:45 (Commercially available as DVB 55 from the Dow Chemical Co.).

It is not possible to define the molecular weight of the divinyl benzene cross-linked styrene polymer herein, since the high level of cross-linking renders it insoluble/intractable.

Suitable styrene is commercially available from Chemicals Inc, Cincinnati, Ohio. Suitable divinyl benzene is commercially available from Dow Chemical Company under the tradename DVB 55.

Suitable divinyl benzene cross-linked styrene polymer may be obtained by any suitable means known to those skilled in the art.

Ground Foam Covalently Cross-Linked Copolymer of Styrene-Co-Divinyl Benzene Particles In a preferred embodiment, the abrasive cleaning particles herein comprising a covalently cross-linked copolymer of styrene-co-divinyl benzene are obtained from a foam and reduced to abrasive cleaning particles preferably via a grinding or milling operation. A preferred route for production of the foam is to form a water/oil High Internal Phase Emulsion (HIPE) of water in the monomer mixture and polymerize in-situ, as described in U.S. Pat. No. 6,369,121 to Catalfamo et al, incorporated by reference herein in its entirety, in particular directed to the making of a water/oil High Internal Phase Emulsion as well as apparatus for use therein.

In this preferred embodiment, said water/oil High Internal Phase Emulsion is obtained by a method for continuous, once-through production of a high internal phase emulsion, the method comprising the steps of:

a) providing a first phase;

b) providing a second phase, wherein said second phase is substantially immiscible with said first phase and the ratio of said first phase to said second phase is between about 2:1 and about 250:1;

c) processing said first and second phases using a first static mixer, having at least one segment, in a single pass so as to provide sufficient shear to emulsify said first phase in said second phase creating said high internal phase emulsion (HIPE) having a internal phase size distribution with a mean particle size.

Preferably said method further comprises a step wherein a portion of said processed HIPE is re-circulated from said outlet of said static mixer and introduced into said inlet where said processed HIPE is processed with the first phase and the second phase.

Said first phase preferably comprises a water phase, including a free radical initiator, and said second phase comprises an oil phase.

The free radical initiator herein can be any conventional water-soluble free radical initiator. These include peroxygen compounds such as sodium, potassium and ammonium persulfates, hydrogen peroxide, sodium peracetate, sodium percarbonate and the like. Conventional redox initiator systems can also be used. Such systems are formed by combining the foregoing peroxygen compounds with reducing agents such as sodium bisulfite, L-ascorbic acid or ferrous salts. The free radical initiator is preferably present at up to about 20 mole percent based on the total moles of polymerizable monomers in the oil phase. Preferably, the initiator is present in an amount of from about 0.001 to 10 mole percent based on the total moles of polymerizable monomers in the oil phase.

The oil phase herein comprises (a), preferably from about 80% to about 98% by weight, of polymerizable monomers, preferably the principal monomeric components such as described herein above under the heading "Covalently cross-linked copolymer of styrene-co-divinyl benzene and particles therefrom", and (b), preferably from about 2% to about 20% by weight of, an emulsifier component or a mixture thereof which is soluble in the oil phase and which is suitable for forming a stable water-in-oil emulsion.

Suitable emulsifiers for use herein can include any of a number of conventional emulsifiers applicable for use in low and mid-internal-phase emulsions.

Usually, these emulsifiers are nonionic materials and can have a wide range of HLB values. Examples of some typical emulsifiers include sorbitan esters such as sorbitan laureates (e.g., SPAN® 20), sorbitan palmitates (e.g., SPAN® 40), sorbitan stearates (e.g., SPAN® 60 and SPAN® 65), sorbitan monooleates (e.g., SPAN® 80), sorbitan trioleates (e.g., SPAN® 85), sorbitan sesquioleates (e.g., EMSORB® 2502), and sorbitan isostearates (e.g., CRILL® 6); polyglycerol esters and ethers (e.g., TRIODAN® 20); polyoxyethylene fatty acids, esters and ethers such as polyoxyethylene (2) oleyl ethers, polyethoxylated oleyl alcohols (e.g. BRIJ® 92 and SIMUSOL®92), etc.; mono-, di-, and triphosphoric esters such as mono-, di-, and triphosphoric esters of oleic acid (e.g., HOSTAPHAT KO3OON), polyoxyethylene sorbitol esters such as polyoxyethylene sorbitol hexastearates (e.g., TLAS® G-1050), ethylene glycol fatty acid esters, glycerol mono-isostearates (e.g., IMWITOR 780K), ethers of glycerol and fatty alcohols (e.g., CREMOPHOR WO/A), esters of polyalcohols, synthetic primary alcohol ethylene oxide condensates (e.g., SYNPERONIC A2), mono and diglycerides of fatty acids (e.g., ATMOS® 300), and the like. Other preferred emulsifiers include the diglycerol esters derived from monooleate, monomyristate, monopalmitate, and monoisostearate acids. A preferred coemulsifier is ditallowedimethyl ammonium methyl sulfate. Mixtures of these emulsifiers are also particularly useful, as are purified versions of each, specifically sorbitan esters containing minimal levels of isosorbide and polyol impurities.

For preferred HIPEs herein, the emulsifiers include sorbitan monoesters of branched C16-C24 fatty acids, linear unsaturated C16-C22 fatty acids, and linear saturated C16-C24 fatty acids, such as sorbitan monooleate, sorbitan monomyristate, and sorbitan monoesters derived from coconut fatty acids; diglycerol monoesters of branched C16-C24 fatty acids, linear unsaturated C16-C22, fatty acids, or linear saturated C12-C14 fatty acids, such as diglycerol monooleate (i.e., diglycerol monoesters of C18:1 fatty acids), diglycerol monomyristate, diglycerol monoisostearate, and diglycerol monoesters of coconut fatty acids; diglycerol monoaliphatic ethers of branched C16-C24 alcohols (e.g. Guerbet alcohols), linear unsaturated C16-C22 alcohols, and linear saturated C12-C14 alcohols (e.g., coconut fatty alcohols), and mixtures of these emulsifiers. See U.S. Pat. No. 5,287,207 (Dyer et al.), issued Feb. 7, 1995 (herein incorporated by reference) which describes the composition and preparation suitable polyglycerol ester emulsifiers and U.S. Pat. No. 5,500,451, issued Mar. 19, 1996 to Stephen A. Goldman et al. (which is incorporated by reference herein), which describes the composition and preparation suitable polyglycerol ether emulsifiers. Preferred emulsifiers include sorbitan monolaureate (e.g., SPAN® 20, preferably greater than about 40%, more preferably greater than about 50%, most preferably greater than about 70% sorbitan monolaureate), sorbitan monooleate (e.g., SPAN® 80, preferably greater than about 40%, more preferably greater than about 50%, most preferably greater than about 70% sorbitan monooleate), diglycerol monooleate (e.g., preferably greater than about 40%, more preferably greater than about 50%, most preferably greater than about 70% diglycerol monooleate), diglycerol monoisostearate (e.g., preferably greater than about 40%, more preferably greater than about 50%, most preferably greater than about 70% diglycerol monoisostearate), diglycerol monomyristate (e-g., preferably greater than about 40%, more preferably greater than about 50%, most preferably greater than about 70% sorbitan monomyristate), the cocoyl (e.g., lauryl and myristoyl)ethers of diglycerol, and mixtures thereof.

A particularly preferred emulsifier is described in U.S. Pat. No. 6,444,716 (Ser. No. 09/490,654) entitled Foam Materials and High Internal Phase Emulsions Made Using Oxidatively Stable Emulsifiers, filed in the name of Hird, et al. Such emulsifiers comprise a composition made by reacting a hydrocarbyl substituted succinic acid or anhydride or a reactive equivalent thereof with either a polyol (or blend of polyols), a polyamine (or blend of polyamines) an alkanolamine (or blend of alkanol amines), or a blend of two or more polyols, polyamines and alkanolamines. The lack of substantial carbon-carbon unsaturation rendering them substantially oxidatively stable.

The produced HIPE emulsion is thereafter heated (preferably to at least about 65° C., more preferably at least about 80° C., most preferably at least about 95° C.) to initiate the free radical polymerization and cured until substantially all of the monomer (at least about 99%) has been converted to polymer. A gradual gradient of temperature, rising from the mix temperature to an elevated temperature, for example rising to about 95° C. over a period of 30 minutes is also operable.

The foam obtained through the HIPE is thereafter reduced to the abrasive cleaning particles according to the present invention have a mean particles size D(v,0.9) of at least about 10 μm by any suitable means, preferably via a grinding or milling operation.

One suitable way of reducing the foam to the abrasive cleaning particles herein is to grind the foam. Other suitable means include the use of eroding tools such as a high speed eroding wheel with dust collector wherein the surface of the wheel is engraved with a pattern or is coated with abrasive sandpaper or the like to promote the foam to form the abrasive cleaning particles herein.

The HIPE foam herein can be ground using commercially available equipment such as the Hosokawa Alpine Grinder.

Alternatively and in a highly preferred embodiment herein, the foam may be reduced to particles in several stages. First the bulk foam can be broken into pieces of a few cm dimensions by manually chopping or cutting, or using a mechanical tool such as a lumpbreaker, for example the Model 2036 from S Howes, Inc. of Silver Creek, N.Y. In a second stage, the lumps are agitated using a propeller or saw toothed disc dispersing tool, which causes the foam to release entrapped water and form a liquid slurry of polymer particles dispersed in aqueous phase. In a third stage, a high shear mixer (such as the Ultra Turrax rotor stator mixer from IKA Works, Inc., Wilmington, N.C.) can be employed to reduce the particle size of the primary slurry to that required for cleaning particles.

In an alternative embodiment herein, the abrasive cleaning particles herein comprising a covalently cross-linked copolymer of styrene-co-divinyl benzene are obtained from a single (preferably solid, non-foam) piece or a multitude thereof, wherein said piece(s) is/are reduced to the abrasive cleaning particles of the present invention, e.g., via a grinding or milling operation. Suitable methods of reducing said piece(s) to the abrasive cleaning particles, such as by grinding or milling operation, are described herein above.

Optional Ingredients

The compositions according to the present invention may comprise a variety of optional ingredients depending on the technical benefit aimed for and the surface treated.

Suitable optional ingredients for use herein include suspending aids, chelating agents, surfactants, radical scavengers, perfumes, surface-modifying polymers, solvents, builders, buffers, bactericides, hydrotropes, colorants, stabilizers, bleaches, bleach activators, suds controlling agents like fatty acids, enzymes, soil suspenders, brighteners, anti dusting agents, dispersants, pigments, and dyes.

Organic Solvent

As an optional but highly preferred ingredient the composition herein comprises an organic solvents or mixtures thereof. The compositions herein comprise from 0% to 30%, more preferably about 1.0% to about 20% and most preferably, about 2% to about 15% by weight of the total composition of an organic solvent or a mixture thereof.

Suitable solvents can be selected from the group consisting of: aliphatic alcohols, ethers and diethers having from about 4 to about 14 carbon atoms, preferably from about 6 to about 12 carbon atoms, and more preferably from about 8 to about 10 carbon atoms; glycols or alkoxylated glycols; glycol ethers; alkoxylated aromatic alcohols; aromatic alcohols; terpenes; and mixtures thereof. Aliphatic alcohols and glycol ether solvents are most preferred.

Aliphatic alcohols, of the formula R—OH wherein R is a linear or branched, saturated or unsaturated alkyl group of from about 1 to about 20 carbon atoms, preferably from about 2 to about 15 and more preferably from about 5 to about 12, are suitable solvents. Suitable aliphatic alcohols are methanol, ethanol, propanol, isopropanol or mixtures thereof. Among aliphatic alcohols, ethanol and isopropanol are most preferred because of their high vapour pressure and tendency to leave no residue.

Suitable glycols to be used herein are according to the formula HO—CR1R2-OH wherein R1 and R2 are independently H or a C2-C10 saturated or unsaturated aliphatic hydrocarbon chain and/or cyclic. Suitable glycols to be used herein are dodecaneglycol and/or propanediol.

In one preferred embodiment, at least one glycol ether solvent is incorporated in the compositions of the present invention. Particularly preferred glycol ethers have a terminal C3-C6 hydrocarbon attached to from one to three ethylene glycol or propylene glycol moieties to provide the appropriate degree of hydrophobicity and, preferably, surface activity. Examples of commercially available solvents based on ethylene glycol chemistry include mono-ethylene glycol n-hexyl ether (Hexyl Cellosolve®) available from Dow Chemical. Examples of commercially available solvents based on propylene glycol chemistry include the di-, and tri-propylene glycol derivatives of propyl and butyl alcohol, which are available from Arco under the trade names Arcosolv® and Dowanol®.

In the context of the present invention, preferred solvents are selected from the group consisting of mono-propylene glycol mono-propyl ether, di-propylene glycol mono-propyl ether, mono-propylene glycol mono-butyl ether, di-propylene glycol mono-propyl ether, di-propylene glycol mono-butyl ether; tri-propylene glycol mono-butyl ether; ethylene glycol mono-butyl ether; di-ethylene glycol mono-butyl ether, ethylene glycol mono-hexyl ether and di-ethylene glycol mono-hexyl ether, and mixtures thereof. "Butyl" includes normal butyl, isobutyl and tertiary butyl groups. Mono-propylene glycol and mono-propylene glycol mono-butyl ether are the most preferred cleaning solvent and are available under the tradenames Dowanol DPnP® and Dowanol DPnB®. Di-propylene glycol mono-t-butyl ether is commercially available from Arco Chemical under the tradename Arcosolv PTB®.

In a particularly preferred embodiment, the cleaning solvent is purified so as to minimize impurities. Such impurities include aldehydes, dimers, trimers, oligomers and other by-products. These have been found to deleteriously affect product odor, perfume solubility and end result. The inventors have also found that common commercial solvents, which contain low levels of aldehydes, can cause irreversible and irreparable yellowing of certain surfaces. By purifying the cleaning solvents so as to minimize or eliminate such impurities, surface damage is attenuated or eliminated.

Though not preferred, terpenes can be used in the present invention. Suitable terpenes to be used herein monocyclic terpenes, dicyclic terpenes and/or acyclic terpenes. Suitable terpenes are: D-limonene; pinene; pine oil; terpinene; terpene derivatives as menthol, terpineol, geraniol, thymol; and the citronella or citronellol types of ingredients.

Suitable alkoxylated aromatic alcohols to be used herein are according to the formula R-$(A)_n$-OH wherein R is an alkyl substituted or non-alkyl substituted aryl group of from about 1 to about 20 carbon atoms, preferably from about 2 to about 15 and more preferably from about 2 to about 10, wherein A is an alkoxy group preferably butoxy, propoxy and/or ethoxy, and n is an integer of from about 1 to about 5, preferably about 1 to about 2. Suitable alkoxylated aromatic alcohols are benzoxyethanol and/or benzoxypropanol.

Suitable aromatic alcohols to be used herein are according to the formula R—OH wherein R is an alkyl substituted or non-alkyl substituted aryl group of from about 1 to about 20 carbon atoms, preferably from about 1 to about 15 and more preferably from about 1 to about 10. For example a suitable aromatic alcohol to be used herein is benzyl alcohol.

Suspending Aid

The abrasive cleaning particles present in the composition herein are solid particles in a liquid composition. Said abrasive cleaning particles may be suspended in the liquid composition. However, it is well within the scope of the present invention that such abrasive cleaning particles are not-stably suspended within the composition and either settle or float on top of the composition. In this case, a user may have to temporally suspend the abrasive cleaning particles by agitating (e.g., shaking or stirring) the composition prior to use.

However, it is preferred herein that the abrasive cleaning particles are stably suspended in the liquid compositions herein. As an optional ingredient, the compositions herein may thus comprise a suspending aid.

The suspending aid herein may either be a compound specifically chosen to provide a suspension of the abrasive cleaning particles in the liquid compositions of the present invention, such as a structurant, or a compound that also provides another function, such as a thickener or a surfactant (as described herein elsewhere).

Any suitable organic and inorganic suspending aids typically used as gelling, thickening or suspending agents in cleaning/cleansing compositions and other detergent or cosmetic compositions may be used herein. Indeed, suitable organic suspending aids include polysaccharide polymers. In addition or as an alternative, polycarboxylate polymer thickeners may be used herein. Also, in addition or as an alternative of the above, layered silicate platelets e.g.: hectorite, bentonite or montmorillonites can also be used.

Suitable commercially available layered silicates are Laponite RD® or Optigel CL® available from Rockwood Additives.

Suitable polycarboxylate polymer thickeners include (preferably lightly) crosslinked polyacrylate. A particularly suitable polycarboxylate polymer thickeners is Carbopol commercially available from Lubrizol under the trade name Carbopol 674®.

Suitable polysaccharide polymers for use herein include substituted cellulose materials like carboxymethylcellulose, ethyl cellulose, hydroxyethyl cellulose, hydroxypropyl cellulose, hydroxymethyl cellulose, succinoglycan and naturally occurring polysaccharide polymers like Xanthan gum, gellan gum, guar gum, locust bean gum, tragacanth gum, Succinoglucan gum, or derivatives thereof, or mixtures thereof. Xanthan gum is commercially available from Kelco under the tradename Kelzan T.

Preferably the suspending aid herein is xanthan gum. In an alternative embodiment, the suspending aid herein is a polycarboxylate polymer thickeners preferably a (preferably lightly) crosslinked polyacrylate. In a highly preferred embodiment herein, the liquid compositions comprise a combination of a polysaccharide polymer or a mixture thereof, preferably Xanthan gum, with a polycarboxylate polymer or a mixture thereof, preferably a crosslinked polyacrylate.

As a preferred example, Xanthan gum is preferably present at levels between 0.1% to 5%%, more preferably 0.5% to 2%, even more preferably 0.8% to 1.2%, by weight of the total composition.

Surfactants

The compositions herein may comprise a nonionic, anionic, zwitterionic, cationic and amphoteric surfactant or mixtures thereof. Suitable surfactants are those selected from the group consisting of nonionic, anionic, zwitterionic, cationic and amphoteric surfactants, having hydrophobic chains containing from about 8 to about 18 carbon atoms. Examples of suitable surfactants are described in McCutcheon's Vol. 1: Emulsifiers and Detergents, North American Ed., McCutcheon Division, MC Publishing Co., 2002.

Preferably, the composition herein comprises from about 0.01% to about 20%, more preferably from about 0.5% to about 10%, and most preferably from about 1% to about 5% by weight of the total composition of a surfactant or a mixture thereof.

Non-ionic surfactants are highly preferred for use in the compositions of the present invention. Non-limiting examples of suitable non-ionic surfactants include alcohol alkoxylates, alkyl polysaccharides, amine oxides, block copolymers of ethylene oxide and propylene oxide, fluoro surfactants and silicon based surfactants. Preferably, the aqueous compositions comprise from about 0.01% to about 20%, more preferably from about 0.5% to about 10%, and most preferably from about 1% to about 5% by weight of the total composition of a non-ionic surfactant or a mixture thereof.

A preferred class of non-ionic surfactants suitable for the present invention is alkyl ethoxylates. The alkyl ethoxylates of the present invention are either linear or branched, and contain from 8 carbon atoms to 16 carbon atoms in the hydrophobic tail; and from 3 ethylene oxide units to 25 ethylene oxide units in the hydrophilic head group. Examples of alkyl ethoxylates include Neodol 91-6®, Neodol 91-8® supplied by the Shell Corporation (P.O. Box 2463, 1 Shell Plaza, Houston, Tex.), and Alfonic 810-60® supplied by Condea Corporation, (900 Threadneedle P.O. Box 19029, Houston, Tex.). More preferred alkyl ethoxylates comprise from 9 to 12 carbon atoms in the hydrophobic tail, and from 4 to 9 oxide units in the hydrophilic head group. A most preferred alkyl ethoxylate is $C_{9-11}$ $EO_5$, available from the Shell Chemical Company under the tradename Neodol 91-5®. Non-ionic ethoxylates can also be derived from branched alcohols. For example, alcohols can be made from branched olefin feedstocks such as propylene or butylene. In a preferred embodiment, the branched alcohol is either a 2-propyl-1-heptyl alcohol or 2-butyl-1-octyl alcohol. A desirable branched alcohol ethoxylate is 2-propyl-1-heptyl EO7/AO7, manufactured and sold by BASF Corporation under the tradename Lutensol XP 79/XL 79®.

Another class of non-ionic surfactant suitable for the present invention is alkyl polysaccharides. Such surfactants are disclosed in U.S. Pat. Nos. 4,565,647, 5,776,872, 5,883,062, and 5,906,973 (all of which are incorporated by reference herein). Among alkyl polysaccharides, alkyl polyglycosides comprising five and/or six carbon sugar rings are preferred, those comprising six carbon sugar rings are more preferred, and those wherein the six carbon sugar ring is derived from glucose, i.e., alkyl polyglucosides ("APG"), are most preferred. The alkyl substituent in the APG chain length is preferably a saturated or unsaturated alkyl moiety containing from about 8 to about 16 carbon atoms, with an average chain length of about 10 carbon atoms. $C_8$-$C_{16}$ alkyl polyglucosides are commercially available from several suppliers (e.g., Simusol® surfactants from Seppic Corporation, 75 Quai d'Orsay, 75321 Paris, Cedex 7, France, and Glucopon 220®, Glucopon 225®. Glucopon 425®, Plantaren 2000 N®, and Plantaren 2000 N UP®, from Cognis Corporation, Postfach 13 01 64, D 40551, Dusseldorf, Germany).

Another class of non-ionic surfactant suitable for the present invention is amine oxide. Amine oxides, particularly those comprising from about 10 carbon atoms to about 16 carbon atoms in the hydrophobic tail, are beneficial because of their strong cleaning profile and effectiveness even at levels below about 0.10%. Additionally $C_{10-16}$ amine oxides, especially $C_{12}$-$C_{14}$ amine oxides are excellent solubilizers of perfume. Alternative non-ionic detergent surfactants for use herein are alkoxylated alcohols generally comprising from 8 to 16 carbon atoms in the hydrophobic alkyl chain of the alcohol. Typical alkoxylation groups are propoxy groups or ethoxy groups in combination with propoxy groups, yielding alkyl ethoxy propoxylates. Such compounds are commercially available under the tradename Antarox® available from Rhodia (40 Rue de la Haie-Coq F-93306, Aubervilliers Cédex, France) and under the tradename Nonidet® available from Shell Chemical.

The condensation products of ethylene oxide with a hydrophobic base formed by the condensation of propylene oxide with propylene glycol are also suitable for use herein. The hydrophobic portion of these compounds will preferably have a molecular weight of from about 1500 to about 1800 and will exhibit water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially available Pluronic® surfactants, marketed by BASF. Chemically, such surfactants have the structure $(EO)_x(PO)_y(EO)_z$ or $(PO)_x(EO)_y(PO)_z$, wherein x, y, and z are from 1 to 100, preferably 3 to 50. Pluronic® surfactants known to be good wetting surfactants are more preferred. A description of the Pluronic® surfactants, and properties thereof, including wetting properties, can be found in the brochure entitled "BASF Performance Chemicals Plutonic® & Tetronic® Surfactants", available from BASF.

Other suitable though not preferred non-ionic surfactants include the polyethylene oxide condensates of alkyl phenols, e.g., the condensation products of alkyl phenols having an alkyl group containing from about 6 to about 12 carbon atoms in either a straight chain or branched chain configuration, with ethylene oxide, the said ethylene oxide being present in amounts equal to about 5 to about 25 moles of ethylene oxide per mole of alkyl phenol. The alkyl substituent in such compounds can be derived from oligomerized propylene, diisobutylene, or from other sources of iso-octane n-octane, iso-nonane or n-nonane. Other non-ionic surfactants that can be used include those derived from natural sources such as sugars and include $C_8$-$C_{16}$ N-alkyl glucose amide surfactants.

Suitable anionic surfactants for use herein are all those commonly known by those skilled in the art. Preferably, the anionic surfactants for use herein include alkyl sulphonates, alkyl aryl sulphonates, alkyl sulphates, alkyl alkoxylated sulphates, $C_6$-$C_{20}$ alkyl alkoxylated linear or branched diphenyl oxide disulphonates, or mixtures thereof.

Suitable alkyl sulphonates for use herein include water-soluble salts or acids of the formula $RSO_3M$ wherein R is a $C_6$-$C_{20}$ linear or branched, saturated or unsaturated alkyl group, preferably a $C_8$-$C_{18}$ alkyl group and more preferably a $C_{10}$-$C_{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like).

Suitable alkyl aryl sulphonates for use herein include water-soluble salts or acids of the formula $RSO_3M$ wherein R is an aryl, preferably a benzyl, substituted by a $C_6$-$C_{20}$ linear or branched saturated or unsaturated alkyl group, preferably a $C_8$-$C_{18}$ alkyl group and more preferably a $C_{10}$-$C_{16}$ alkyl group, and M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like).

An example of a $C_{14}$-$C_{16}$ alkyl sulphonate is Hostapur® SAS available from Hoechst. An example of commercially available alkyl aryl sulphonate is Lauryl aryl sulphonate from Su.Ma. Particularly preferred alkyl aryl sulphonates are alkyl benzene sulphonates commercially available under trade name Nansa® available from Albright&Wilson.

Suitable alkyl sulphate surfactants for use herein are according to the formula $R_1SO_4M$ wherein $R_1$ represents a hydrocarbon group selected from the group consisting of straight or branched alkyl radicals containing from about 6 to about 20 carbon atoms and alkyl phenyl radicals containing from 6 to 18 carbon atoms in the alkyl group. M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like).

Particularly preferred branched alkyl sulphates to be used herein are those containing from 10 to 14 total carbon atoms like Isalchem 123 AS®. Isalchem 123 AS® commercially available from Enichem is a $C_{12-13}$ surfactant which is 94% branched. This material can be described as $CH_3$—$(CH_2)_m$—$CH(CH_2OSO_3Na)$—$(CH_2)_n$—$CH_3$ where n+m=8–9. Also preferred alkyl sulphates are the alkyl sulphates where the alkyl chain comprises a total of about 12 carbon atoms, i.e., sodium 2-butyl, octyl sulphate. Such alkyl sulphate is commercially available from Condea under the trade name Isofol® 12S. Particularly suitable liner alkyl sulphonates include $C_{12}$-$C_{16}$ paraffin sulphonate like Hostapur® SAS commercially available from Hoechst.

Suitable alkyl alkoxylated sulphate surfactants for use herein are according to the formula $RO(A)_mSO_3M$ wherein R is an unsubstituted $C_6$-$C_{20}$ alkyl or hydroxyalkyl group having a $C_6$-$C_{20}$ alkyl component, preferably a $C_{12}$-$C_{20}$ alkyl or hydroxyalkyl, more preferably $C_{12}$-$C_{18}$ alkyl or hydroxyalkyl, A is an ethoxy or propoxy unit, m is greater than zero, typically between 0.5 and 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperidinium and cations derived from alkanolamines such as ethylamine, diethylamine, triethylamine, mixtures thereof, and the like. Exemplary surfactants are $C_{12}$-$C_{18}$ alkyl polyethoxylate (1.0) sulfate ($C_{12}$-$C_{18}E(1.0)SO_3M$), $C_{12}$-$C_{18}$ alkyl polyethoxylate (2.25) sulfate ($C_{12}$-$C_{18}E(2.25)SO_3M$), $C_{12}$-$C_{18}$ alkyl polyethoxylate (3.0) sulfate ($C_{12}$-$C_{18}E(3.0)SO_3M$), and $C_{12}$-$C_{18}$ alkyl polyethoxylate (4.0) sulfate ($C_{12}$-$C_{18}E(4.0)SO_3M$), wherein M is conveniently selected from sodium and potassium.

Suitable $C_6$-$C_{20}$ alkyl alkoxylated linear or branched diphenyl oxide disulphonate surfactants for use herein are according to the following formula:

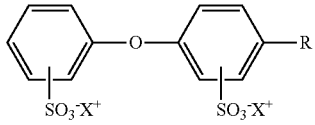

wherein R is a $C_6$-$C_{20}$ linear or branched, saturated or unsaturated alkyl group, preferably a $C_{12}$-$C_{18}$ alkyl group and more preferably a $C_{14}$-$C_{16}$ alkyl group, and X+ is H or a cation, e.g., an alkali metal cation (e.g., sodium, potassium, lithium, calcium, magnesium and the like). Particularly suitable $C_6$-$C_{20}$ alkyl alkoxylated linear or branched diphenyl oxide disulphonate surfactants to be used herein are the C12 branched di phenyl oxide disulphonic acid and C16 linear di phenyl oxide disulphonate sodium salt respectively commercially available by DOW under the trade name Dowfax 2A1® and Dowfax 8390®.

Other anionic surfactants useful herein include salts (including, for example, sodium, potassium, ammonium, and substituted ammonium salts such as mono-, di- and triethanolamine salts) of soap, $C_8$-$C_{24}$ olefinsulfonates, sulphonated polycarboxylic acids prepared by sulphonation of the pyrolyzed product of alkaline earth metal citrates, e.g., as described in British patent specification No. 1,082,179, $C_8$-$C_{24}$ alkylpolyglycolethersulfates (containing up to 10 moles of ethylene oxide), incorporated herein by reference; alkyl ester sulfonates such as $C_{14-16}$ methyl ester sulfonates; acyl glycerol sulfonates, fatty oleyl glycerol sulfates, alkyl phenol ethylene oxide ether sulfates, alkyl phosphates, isethionates such as the acyl isethionates, N-acyl taurates, alkyl succinamates and sulfosuccinates, monoesters of sulfosuccinate (especially saturated and unsaturated $C_{12}$-$C_{18}$ monoesters) diesters of sulfosuccinate (especially saturated and unsaturated $C_6$-$C_{14}$ diesters), acyl sarcosinates, sulfates of alkylpolysaccharides such as the sulfates of alkylpolyglucoside (the nonionic nonsulfated compounds being described below), alkyl polyethoxy carboxylates such as those of the formula $RO(CH_2CH_2O)_kCH_2COO\text{-}M^+$ wherein R is a $C_8$-$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23, incorporated herein by reference.

Zwitterionic surfactants represent another class of preferred surfactants within the context of the present invention.

Zwitterionic surfactants contain both cationic and anionic groups on the same molecule over a wide pH range. The typical cationic group is a quaternary ammonium group, although other positively charged groups like sulfonium and phosphonium groups can also be used. The typical anionic groups are carboxylates and sulfonates, preferably sulfonates, although other groups like sulfates, phosphates and the like can be used. Some common examples of these detergents are described in the patent literature: U.S. Pat. Nos. 2,082,275, 2,702,279 and 2,255,082, all of which are incorporated by reference herein.

A specific example of a zwitterionic surfactant is 3-(N-dodecyl-N,N-dimethyl)-2-hydroxypropane-1-sulfonate (Lauryl hydroxyl sultaine) available from the McIntyre Company (24601 Governors Highway, University Park, Ill. 60466, USA) under the tradename Mackam LHS®. Another specific zwitterionic surfactant is $C_{12-14}$ acylamidopropylene (hydroxypropylene) sulfobetaine that is available from McIntyre under the tradename Mackam 50-SB®. Other very useful zwitterionic surfactants include hydrocarbyl, e.g., fatty alkylene betaines. A highly preferred zwitterionic surfactant is Empigen BB®, a coco dimethyl betaine produced by Albright & Wilson. Another equally preferred zwitterionic surfactant is Mackam 35HP®, a coco amido propyl betaine produced by McIntyre.

Another class of preferred surfactants comprises the group consisting of amphoteric surfactants. One suitable amphoteric surfactant is a $C_8$-$C_{16}$ amido alkylene glycinate surfactant ('ampho glycinate'). Another suitable amphoteric surfactant is a $C_8$-$C_{16}$ amido alkylene propionate surfactant ('ampho propionate'). Other suitable, amphoteric surfactants are represented by surfactants such as dodecylbeta-alanine, N-alkyltaurines such as the one prepared by reacting dodecylamine with sodium isethionate according to the teaching of U.S. Pat. No. 2,658,072, N-higher alkylaspartic acids such as those produced according to the teaching of U.S. Pat. No. 2,438,091, and the products sold under the trade name "Miranol®", and described in U.S. Pat. No. 2,528,378 (all of the above are incorporated by reference herein).

Chelating Agents

One class of optional compounds for use herein includes chelating agents or mixtures thereof. Chelating agents can be incorporated in the compositions herein in amounts ranging from about 0.0% to about 10.0% by weight of the total composition, preferably about 0.01% to about 5.0%.

Suitable phosphonate chelating agents for use herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins (incorporated by reference herein). Ethylenediamine N,N'-disuccinic acids is, for instance, commercially available under the tradename ssEDDS® from Palmer Research Laboratories.

Suitable amino carboxylates for use herein include ethylene diamine tetra acetates, diethylene triamine pentaacetates, diethylene triamine pentaacetate (DTPA),N-hydroxyethylethylenediamine triacetates, nitrilotri-acetates, ethylenediamine tetrapropionates, triethylenetetraaminehexa-acetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Further carboxylate chelating agents for use herein include salicylic acid, aspartic acid, glutamic acid, glycine, malonic acid or mixtures thereof.

Radical Scavenger

The compositions of the present invention may further comprise a radical scavenger or a mixture thereof.

Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anisole, benzoic acid, toluic acid, catechol, t-butyl catechol, benzylamine, 1,1,3-tris(2-methyl-4-hydroxy-5-t-butylphenyl) butane, n-propyl-gallate or mixtures thereof and highly preferred is di-tert-butyl hydroxy toluene. Such radical scavengers like N-propyl-gallate may be commercially available from Nipa Laboratories under the trade name Nipanox S1®.

Radical scavengers, when used, may be typically present herein in amounts up to about 10% by weight of the total composition and preferably from about 0.001% to about 0.5% by weight. The presence of radical scavengers may contribute to the chemical stability of the compositions of the present invention.

Perfume

Suitable perfume compounds and compositions for use herein are for example those described in EP-A-0 957 156 under the paragraph entitled "Perfume", on page 13 (incorporated by reference herein). The compositions herein may comprise a perfume ingredient, or mixtures thereof, in amounts up to about 5.0% by weight of the total composition, preferably in amounts of about 0.1% to about 1.5%.

Dye

The liquid compositions according to the present invention may be coloured. Accordingly, they may comprise a dye or a mixture thereof.

Delivery Form of the Compositions

The compositions herein may be packaged in a variety of suitable packaging known to those skilled in the art, such as plastic bottles for pouring liquid compositions, squeeze bottles or bottles equipped with a trigger sprayer for spraying liquid compositions. Alternatively, the paste-like compositions according to the present invention may by packaged in a tube.

In an alternative embodiment herein, the liquid composition herein is impregnated onto a substrate, preferably the substrate is in the form of a flexible, thin sheet or a block of material, such as a sponge.

Suitable substrates are woven or non-woven sheets, cellulosic material based sheets, sponge or foam with open cell structures e.g.: polyurethane foams, cellulosic foam, melamine foam, etc.

The Method of Cleaning a Surface

The present invention encompasses a method of cleaning and/or cleansing a surface with a liquid composition according to the present invention. Suitable surfaces herein are described herein above under the heading "The liquid cleaning/cleansing composition".

In a preferred embodiment said surface is contacted with the composition according to the present invention, preferably wherein said composition is applied onto said surface.

In a highly preferred embodiment herein, present invention encompasses a method of cleaning a household hard surface with a liquid composition according to the present invention.

In another preferred embodiment, the method herein comprises the steps of dispensing (e.g., by spraying, pouring, squeezing) the liquid composition according to the present invention from a container containing said liquid composition and thereafter cleaning and/or cleansing said surface.

The composition herein may be in its neat form or in its diluted form.

By "in its neat form", it is to be understood that said liquid composition is applied directly onto the surface to be treated without undergoing any dilution, i.e., the liquid composition herein is applied onto the surface as described herein.

By "diluted form", it is meant herein that said liquid composition is diluted by the user typically with water. The liquid composition is diluted prior to use to a typical dilution level of up to 10 times its weight of water. A usually recommended dilution level is a 10% dilution of the composition in water.

The composition herein may be applied using an appropriate implement, such as a mop, paper towel, brush (e.g., a toothbrush) or a cloth, soaked in the diluted or neat composition herein. Furthermore, once applied onto said surface said composition may be agitated over said surface using an appropriate implement. Indeed, said surface may be wiped using a mop, paper towel, brush or a cloth.

The method herein may additionally contain a rinsing step, preferably after the application of said composition. By "rinsing", it is meant herein contacting the surface cleaned/cleansed with the method according to the present invention with substantial quantities of appropriate solvent, typically water, directly after the step of applying the liquid composition herein onto said surface. By "substantial quantities", it is meant herein between about 0.01 lt. and about 1 lt. of water per $m^2$ of surface, more preferably between about 0.1 lt. and about 1 lt. of water per $m^2$ of surface.

EXAMPLES

These following compositions were made comprising the listed ingredients in the listed proportions (weight %). Examples 1-43 herein are meant to exemplify the present invention but are not necessarily used to limit or otherwise define the scope of the present invention.

The Crosslinked PS-DVB—divinyl benzene cross-linked styrene polymer—(percentage level of DVB 55, and mean diameter D(v,0.9)) abrasive cleaning particles in the below examples are obtained according to the preferred process as described under the heading "Ground foam Covalently cross-linked copolymer of styrene-co-divinyl benzene particles" herein above.

Hard surface cleaner Bathroom composition

| % Weight | 1 | 2 | 3 |
|---|---|---|---|
| C9-C11 EO8 (Neodol 91-8) | 3 | 2.5 | 3.5 |
| Alkyl Benzene sulfonate | | 1 | |
| C12-14-dimethyl Amineoxide | | 1 | |
| n-Butoxy Propoxy Propanol | | 2 | 2.5 |
| Hydrogen Peroxide | 3 | | |
| Hydrophobic ethoxylated polyurethane (Acusol 882) | 1.5 | 1 | 0.8 |

-continued

Hard surface cleaner Bathroom composition

| | | | |
|---|---|---|---|
| Lactic Acid | 3 | | 3.5 |
| Citric Acid | | 3 | 0.5 |
| Polysaccharide (Xanthan Gum, Keltrol CG-SFT Kelco) | 0.25 | 0.25 | 0.25 |
| Perfume | 0.35 | 0.35 | 0.35 |
| Crosslinked PS-DVB (40% DVB 55, mean diameter D(v, 0.9) 20 μm) abrasive cleaning particles | 1 | 1 | 1 |
| Water | Balance | Balance | Balance |

| % Weight | 4 | 5 | 6 |
|---|---|---|---|
| Chloridric acid | 2 | | |
| Linear C10 alkyl sulphate | 1.3 | 2 | 3 |
| n-Butoxy Propoxy Propanol | 2 | | 1.75 |
| Citric Acid | | 3 | 3 |
| Polyvinylpyrrolidone (Luviskol K60) | 0.1 | 0.1 | 0.1 |
| NaOH | | 0.2 | 0.2 |
| Perfume | 0.4 | 0.4 | 0.4 |
| Polysaccharide (Xanthan Gum Kelzan T, Kelco) | 0.3 | 0.35 | 0.35 |
| Crosslinked PS-DVB (50% DVB 55, mean diameter D(v, 0.9) 15 μm) abrasive cleaning particles | 2 | 2 | 2 |
| Water | Balance | Balance | Balance |

Hand-dishwashing detergent compositions

| % Weight | 7 | 8 | 9 |
|---|---|---|---|
| N-2-ethylhexyl sulfosuccinamate | 3 | 3 | 3 |
| C11-EO5 nonionic surfactant | 7 | 14 | |
| C11-EO7 nonionic surfactant | | | 7 |
| C10-EO7 nonionic surfactant | 7 | | 7 |
| Trisodium Citrate | 1 | 1 | 1 |
| Potassium Carbonate | 0.2 | 0.2 | 0.2 |
| Perfume | 1 | 1 | 1 |
| Polysaccharide (Xanthan Gum Kelzan T, Kelco) | 0.35 | 0.35 | 0.35 |
| Crosslinked PS-DVB (80% DVB 55, mean diameter D(v, 0.9) 40 μm) abrasive cleaning particles | 2 | 2 | 2 |
| Water (+ minor e.g.; pH adjusted to 10.5) | Balance | Balance | Balance |

General degreaser composition

| % Weight | 10 | 11 |
|---|---|---|
| C9-C11 EO8 (Neodol 91-8) | 3 | 3 |
| N-Butoxy Propoxy Propanol | 15 | 15 |
| Ethanol | 10 | 5 |
| Isopropanol | | 10 |
| Polysaccharide (Xanthan Gum-glyoxal modified Optixan-T) | 0.35 | 0.35 |
| Crosslinked PS-DVB (50% DVB 55, mean diameter D(v, 0.9) 15 μm) abrasive cleaning particles | 1 | 1 |
| Water (+ minor e.g.; pH adjusted to alkaline pH) | Balance | Balance |

Scouring composition

| % Weight | 12 | 13 | 14 |
|---|---|---|---|
| Sodium C13-16 paraffin sulfonate | 2.5 | 2.5 | 2.5 |
| C12-14-EO7 (Lutensol AO7) | 0.5 | 0.5 | 0.5 |
| Coconut Fatty Acid | 0.3 | 0.3 | 0.3 |

-continued

Scouring composition

| % Weight | 12 | 13 | 14 |
|---|---|---|---|
| Sodium Citrate | 3.3 | 3.3 | 3.3 |
| Sodium Carbonate | 3 | 3 | 3 |
| Orange terpenes | 2.1 | 2.1 | 2.1 |
| Benzyl Alcohol | 1.5 | 1.5 | |
| Polyacrylic acid 1.5 Mw | 0.75 | 0.75 | 0.75 |
| Diatomaceous earth (Celite 499 median size 10 μm) | 25 | | |
| Calcium Carbonate (Merk 2066 median size 10 μm) | | 25 | |
| Crosslinked PS-DVB (50% DVB 55, mean diameter D(v, 0.9) 15 μm) abrasive cleaning particles | 5 | 5 | 5 |
| Water | Balance | Balance | Balance |

Liquid glass cleaner

| % Weight | 15 | 16 |
|---|---|---|
| Butoxypropanol | 2 | 4 |
| Ethanol | 3 | 6 |
| C12-14 sodium sulphate | 0.24 | |
| NaOH/Citric acid | To pH 10 | |
| Citric Acid | | |
| Crosslinked PS-DVB (40% DVB 55, mean diameter D(v, 0.9) 10 μm) abrasive cleaning particles | 0.5 | 0.5 |
| Water (+ minor) | Balance | Balance |

Cleaning wipe (Body cleansing wipe)

| % Weight | 17 | 18 | 19 |
|---|---|---|---|
| C10 Amine Oxide | — | 0.02 | — |
| C12,14 Amine Oxide | 0.4 | — | — |
| Betaine (Rewoteric AM CAS 15 U) | — | — | 0.2 |
| C9,11 EO5 nonionic surfactant (Neodol E 91.5) | — | 0.1 | — |
| C9,11 EO8 nonionic surfactant (Neodol E 91.8) | — | — | 0.8 |
| C12,14 EO5 nonionic surfactant | 0.125 | — | — |
| 2-Ethyl Hexyl Sulphate | — | 0.05 | 0.6 |
| Silicone | 0.001 | 0.003 | 0.003 |
| EtOH | 9.4 | 8.0 | 9.5 |
| Propylene Glycol Butyl Ether | 0.55 | 1.2 | — |
| Geraniol | — | — | 0.1 |
| Citric acid | 1.5 | — | — |
| Lactic acid | — | | 1.5 |
| Perfume | 0.25 | 0.15 | 0.15 |
| Crosslinked PS-DVB (50% DVB 55, mean diameter D(v, 0.9) 17 μm) abrasive cleaning particles | 5 | 3 | 3 |
| Nonwoven: Spunlace 100% viscose 50gsm (lotion loading fact) | | | (x3.5) |
| Nonwoven: Airlaid walkisoft (70% cellulose, 12% Viscose, 18% binder) 80gsm (lotion loading factor) | | (x3.5) | |
| Carded thermobonded (70% polypropylene, 30% rayon), 70gsm (Lotion loading factor) | (x3.5) | | |

| % Weight | 19 |
|---|---|
| Benzalkonioum Chloride (Alkaquat DMB-451) | 0.1 |
| Cocoamine Oxide (C10/C16 alkyl dimethyl amine oxide; AO-1214 LP supplied by Procter & Gamble Co.) | 0.5 |
| Pyroglutamic Acid (pidolidone) (2-pyrrolidone-5 carboxylic acid) | 4 |
| Ethanol-denatured 200 proof (SD alcohol 40) | 10 |
| DC Antifoam H-10 (dimethicone) | 0.03 |

-continued

Cleaning wipe (Body cleansing wipe)

| | |
|---|---|
| Sodium Benzoate | 0.2 |
| Tetrasodium EDTA (Hampene 220) | 0.1 |
| Sodium Chloride | 0.4 |
| Perfume | 0.01 |
| Crosslinked PS-DVB (50% DVB 55, mean diameter D(v, 0.9) 17 μm) abrasive cleaning particles | 2 |
| Water and minors | q.s. |

The above wipes lotion composition is loaded onto a water-insoluble substrate, being a patterned hydroentangled non-woven substrate having a basis weight of 56 gms comprising 70% polyester and 30% rayon approximately 6.5 inches wide by 7.5 inches long with a caliper of about 0.80 mm. Optionally, the substrate can be pre-coated with dimethicone (Dow Corning 200 Fluid 5 cst) using conventional substrate coating techniques. Lotion to wipe weight ratio of about 2:1 using conventional substrate coating techniques.

Oral care composition (toothpaste)

| % Weight | 20 | 21 |
|---|---|---|
| Sorbitol (70% sol.) | 24.2 | 24.2 |
| Glycerin | 7 | 7 |
| Carboxymethylcellulose | 0.5 | 0.5 |
| PEG-6 | 4 | 4 |
| Sodium Fluoride | 0.24 | 0.24 |
| Sodium Saccharine | 0.13 | 0.13 |
| Mono Sodium phosphate | 0.41 | 0.41 |
| Tri Sodium phosphate | 0.39 | 0.39 |
| Sodium Tartrate | 1 | 1 |
| TiO2 | 0.5 | 0.5 |
| Silica | 35 | |
| Sodium lauroyl sarcosinate (95% active) | 1 | 1 |
| Flavor | 0.8 | 0.8 |
| Crosslinked PS-DVB (40% DVB 55, mean diameter D(v, 0.9) 10 μm) abrasive cleaning particles | 2 | 5 |
| Water | Balance | Balance |

Body Cleansing composition

| % Weight | 22 | 23 |
|---|---|---|
| Cocoamidopropyl betaine | 5.15 | 5.15 |
| Sodium Laureth sulfate | 5.8 | 5.8 |
| Sodium Lauroyl sarcosinate | 0.5 | 0.5 |
| Polyquaternium 10 | 0.1 | 0.1 |
| C12-14 fatty alcohol | 0.45 | 0.45 |
| Zinc Stearate | 1.5 | 1.5 |
| Glycol Distearate | 0.25 | 0.25 |
| Sodium lauryl sulfate | 0.53 | 0.53 |
| Cocoamidopropyl betaine | 0.17 | 0.17 |
| Lauramide Diethanolamide | 0.48 | 0.48 |
| Sodium sulfate | 0.05 | 0.05 |
| Citric Acid | 0.05 | 0.05 |
| DMDM hydantoin (1,3-Dimethylol-5,5-dimethylhydantoin Glydant) | 0.2 | 0.2 |
| Tetra Sodium EDTA | 0.1 | 0.1 |
| Fragrance | 0.5 | 0.5 |
| Polysaccharide (Xanthan Gum-glyoxal modified Optixan-T) | 0.2 | 0.2 |
| Crosslinked PS-DVB (50% DVB 55, mean diameter D(v, 0.9) 20 μm) abrasive cleaning particles | 2 | 1 |
| Crosslinked PS-DVB (50% DVB 55, mean diameter D(v, 0.9) 75 μm) abrasive cleaning particles | | 1 |
| Water | Balance | Balance |

Facial Cleansing Compositions

| Ingredients | 24 | 25 | 26 | 27 |
|---|---|---|---|---|
| Acrylates Copolymer[1] | 1.50 | 2.0 | 1.25 | — |
| Acrylates/$C_{10-30}$ alkyl acrylate crosspolymer[2] | — | — | — | 1.0 |
| Sodium Lauryl Sulfate | 2.0 | — | — | — |
| Sodium Laureth Sulfate | 8.0 | — | — | — |
| Ammonium Lauryl Sulfate | — | 6.0 | — | — |
| Sodium Trideceth Sulfate | — | — | 3.0 | 2.5 |
| Sodium Myristoyl Sarcosinate | — | 2.0 | 3.0 | 2.5 |
| Sodium Lauroamphoacetate[3] | — | — | 6.0 | 5.0 |
| Sodium Hydroxide* | pH > 6 | — | — | — |
| Triethanolamine* | — | pH > 6 | — | pH 5.2 |
| Cocamidopropyl Betaine | 4.0 | 7.0 | — | — |
| Glycerin | 4.0 | 5.0 | 2.0 | 2.0 |
| Sorbitol | — | — | 2.0 | 2.0 |
| Salicylic Acid | — | — | 2.0 | 2.0 |
| Fragrance | 0.1 | 0.1 | 0.1 | 0.1 |
| Preservative | 0.3 | 0.3 | 0.15 | 0.15 |
| Crosslinked PS-DVB (50% DVB 55, mean diameter D(v, 0.9) 200 μm) abrasive cleaning particles | 1.0 | 1.0 | 2.0 | 2.0 |
| PEG 120 Methyl Glucose Trioleate[4] | 0.5 | — | 0.25 | 0.25 |
| PEG 150 Pentaerythrityl Tetrastearate[5] | — | 0.40 | — | — |
| Citric Acid** | pH 5.5 | pH 5.5 | pH 5.5 | pH 5.5 |
| Water | QS to 100% | QS to 100% | QS to 100% | QS to 100% |

*per the supplier use directions, the base is used to activate the acrylates copolymer
**acid can be added to adjust the formula to a lower pH
[1]Carbopol Aqua SF-1 ® from Noveon ™, Inc.
[2]Carbopol Ultrez 21 ® from Noveon ™, Inc.
[3]Miranol ® Ultra L32 from Rhodia
[4]Glucamate LT ® from Chemron
[5]Crothix ® from Croda Examples 24 to 27 are made the following way:
Add Carbopol® to de-ionized free water of the formulation. Add all surfactants except cationics and betaines. If the pH is less than 6 then add a neutralizing agent (typically a base i.e., Triethanolamine, sodium hydroxide) to adjust to a pH greater than 6. If necessary, apply gentle heat to reduce viscosity and help minimize air entrapment. Add betaine and/or cationic surfactants. Add conditioning agents, additional rheology modifiers, pearlizing agents, encapsulated materials, exfoliants, preservatives, dyes, fragrances, abrasive particles and other desirable ingredients. Lastly, if desired reduce the pH with an acid (i.e. citric acid) and increase viscosity by adding sodium chloride.

Oral care composition (toothpaste)

| | 28 | 29 | 30 | 31 | 32 |
|---|---|---|---|---|---|
| Sodium Gluconate | 1.064 | 1.064 | 1.064 | 1.064 | 0.600 |
| Stannous fluoride | 0.454 | 0.454 | 0.454 | 0.454 | 0.454 |
| Sodium fluoride | | | | | |
| Sodium monofluorophosphate | | | | | |

-continued

Oral care composition (toothpaste)

| | | | | | |
|---|---|---|---|---|---|
| Zinc Lactate | 0.670 | 0.670 | 0.670 | 0.670 | 2.500 |
| Glycerin | — | — | — | — | 36.000 |
| Polyethylene glycol 300 | | | | | 7.000 |
| Propylene Glycol | | | | | 7.000 |
| Sorbitol(LRS) USP | 39.612 | 39.612 | 39.612 | 39.612 | — |
| Sodium lauryl sulfate solution (28%) | 5.000 | 5.000 | 5.000 | 5.000 | 3.500 |
| Crosslinked PS-DVB (50% DVB 55, mean diameter D(v, 0.9) 20 μm) abrasive cleaning particles | 10.000 | 10.000 | 1.000 | 5.000 | 5.000 |
| Zeodent 119 | — | — | — | — | — |
| Zeodent 109 | | | 10.000 | 10.000 | 10.000 |
| Hydrogen peroxide (35% soln) | | | | | |
| Sodium hexametaphosphate | — | — | — | — | 13.000 |
| Gantrez | | 2.000 | 2.000 | 2.000 | — |
| Natural CaCO3-600M | — | — | — | — | — |
| Sodium phosphate (mono basic) | — | — | — | — | — |
| Sodium phosphate (Tri basic) | — | — | — | — | 1.000 |
| Zeodent 165 | — | — | — | — | — |
| Cocoamidopropyl Betaine (30% Soln) | — | — | — | — | — |
| Cetyl Alcohol | 3.000 | — | — | — | — |
| Stearyl Alcohol | 3.000 | — | — | — | — |
| Hydroxyethyl cellulose (HEC Natrasol 250M) | — | 0.500 | 0.500 | 0.500 | — |
| CMC 7M8SF | — | 1.300 | 1.300 | 1.300 | — |
| Xanthan Gum | — | — | — | — | 0.250 |
| Poloxamer 407 | — | — | — | — | — |
| Carrageenan mixture | — | 0.700 | 0.700 | 0.700 | 0.600 |
| Titanium dioxide | — | — | — | — | — |
| Saccharin Sodium | 0.500 | 0.500 | 0.500 | 0.500 | 0.500 |
| Flavor | 1.000 | 1.000 | 1.000 | 1.000 | 1.000 |
| Water | QS | QS | QS | QS | QS |

| | 33 | 34 | 35 | 36 | 37 |
|---|---|---|---|---|---|
| Sodium Gluconate | — | — | — | — | — |
| Stannous fluoride | — | — | — | — | — |
| Sodium fluoride | — | 0.243 | 0.243 | 0.243 | — |
| Sodium monofluorophosphate | 1.10 | | | | — |
| Zinc Lactate | — | — | — | — | — |
| Glycerin | — | — | — | — | 40.000 |
| Polyethylene glycol 300 | — | — | — | — | — |
| Propylene Glycol | | | | | |
| Sorbitol(LRS) USP | 24.000 | 42.500 | 42.500 | 42.500 | 30.000 |
| Sodium lauryl sulfate solution (28%) | 4.000 | 4.000 | — | 4.000 | — |
| Crosslinked PS-DVB (50% DVB 55, mean diameter D(v, 0.9) 20 μm) abrasive cleaning particles | 5.000 | 10.000 | 10.000 | 5.000 | 15.000 |
| Zeodent 119 | — | — | — | 10.000 | — |
| Zeodent 109 | | | | | |
| Hydrogen peroxide (35% soln) | | | | | |
| Sodium hexametaphosphate | — | — | — | — | — |
| Gantrez | | | | | |
| Natural CaCO3-600M | 35.00 | — | — | — | — |
| Sodium phosphate (mono basic) | 0.10 | 0.420 | 0.420 | 0.420 | 0.420 |
| Sodium phosphate (Tri basic) | 0.40 | 1.100 | 1.100 | 1.100 | 1.100 |
| Zeodent 165 | 2.00 | — | — | — | 2.000 |
| Cocoamidopropyl Betaine (30% Soln) | — | — | 5.000 | — | — |
| Cetyl Alcohol | 0.000 | — | — | — | — |
| Stearyl Alcohol | 0.000 | — | — | — | — |

-continued

| Oral care composition (toothpaste) | | | | | |
|---|---|---|---|---|---|
| Hydroxyethyl cellulose (HEC Natrasol 250M) | — | 0.500 | 0.500 | 0.500 | — |
| CMC 7M8SF | 1.300 | 1.300 | 1.300 | 1.300 | 1.300 |
| Xanthan Gum | — | — | — | — | — |
| Poloxamer 407 | — | — | — | — | — |
| Carrageenan mixture | — | 0.700 | 0.700 | 0.700 | — |
| Titanium dioxide | — | — | — | — | — |
| Saccharin Sodium | 0.250 | 0.500 | 0.500 | 0.500 | 0.500 |
| Flavor | 1.000 | 1.000 | 1.000 | 1.000 | 1.000 |
| Water | QS | QS | QS | QS | QS |

| | 38 | 39 | 40 |
|---|---|---|---|
| Sodium Gluconate | — | — | 1.500 |
| Stannous fluoride | — | — | 0.454 |
| Sodium fluoride | — | — | — |
| Sodium monofluorophosphate | — | — | — |
| Zinc Lactate | — | — | — |
| Glycerin | 40.000 | 10.000 | 25.000 |
| Polyethylene glycol 300 | 3.000 | — | — |
| Propylene Glycol | — | — | — |
| Sorbitol(LRS) USP | — | 39.612 | — |
| Sodium lauryl sulfate solution (28%) | 5.000 | 4.000 | 4.000 |
| Crosslinked PS-DVB (50% DVB 55, mean diameter D(v, 0.9) 20 μm) abrasive cleaning particles | 15.000 | 5.000 | 5.000 |
| Zeodent 119 | — | — | — |
| Zeodent 109 | | | |
| Hydrogen peroxide (35% soln) | — | 8.570 | 8.570 |
| Sodium hexametaphosphate | 14.000 | — | — |
| Gantrez | — | — | — |
| Natural CaCO3-600M | — | — | — |
| Sodium phosphate (mono basic) | 0.420 | — | — |
| Sodium phosphate (Tri basic) | 1.100 | — | — |
| Zeodent 165 | 2.000 | — | — |
| Cocoamidopropyl Betaine (30% Soln) | — | — | — |
| Cetyl Alcohol | — | 3.000 | — |
| Stearyl Alcohol | — | 3.000 | — |
| Hydroxyethyl cellulose (HEC Natrasol 250M) | — | — | — |
| CMC 7M8SF | 1.000 | — | — |
| Xanthan Gum | 0.300 | — | — |
| Poloxamer 407 | 0.500 | — | 18.000 |
| Carrageenan mixture | — | — | — |
| Titanium dioxide | 0.500 | — | — |
| Saccharin Sodium | 0.500 | 0.500 | 0.500 |
| Flavor | 1.000 | 1.000 | 1.000 |
| Water | QS | QS | QS |

Zeodent 119, 109 and 165 are precipitated silica materials sold by the J. M. Huber Corporation.

Gantrez is a copolymer of maleic anhydride or acid and methyl vinyl ether.

CMC 7M8SF is a sodium carboxymethylcellulose.

Poloxamer is a difunctional block-polymer terminating in primary hydroxyl groups.

| Hair Shampoo | 41 | 42 | 43 |
|---|---|---|---|
| Water | q.s. | q.s. | q.s. |
| Polyquaterium 76[1] | 0.25 | — | — |
| Guar, Hydroxylpropyl Trimonium Chloride[2] | — | 0.25 | — |
| Polyquaterium 6[3] | — | — | 0.25 |
| Sodium Laureth Sulfate | 12 | 10.5 | 10.5 |

-continued

| Hair Shampoo | 41 | 42 | 43 |
|---|---|---|---|
| Sodium Lauryl Sulfate | | 1.5 | 1.5 |
| Silicone[4] | 0.75 | 1.00 | 0.5 |
| Cocoamidopropyl Betaine | 3.33 | 3.33 | 3.33 |
| Cocoamide MEA | 1.0 | 1.0 | 1.0 |
| Ethylene Glycol Distearate | 1.50 | 1.50 | 1.50 |
| Crosslinked PS-DVB (50% DVB 55, mean diameter D(v, 0.9) 20 μm) abrasive cleaning particles | 1 | | 2 |
| Crosslinked PS-DVB (50% DVB 55, mean diameter D(v, 0.9) 75 μm) abrasive cleaning particles | | 1 | |
| Fragrance | 0.70 | 0.70 | 0.70 |
| Preservatives, pH & Visc. adjusters | Up to 1% | Up to 1% | Up to 1% |

[1]Copolymer of Acrylamide (AM) and TRIQUAT, MW = 1,000,000; CD = 1.6 meq./gram; Rhodia

[2]Jaguar C500, MW - 500,000, CD = 0.7, Rhodia

[3]Mirapol 100S, 31.5% active, Rhodia

[4]Dimethicone Fluid, Viscasil 330M; 30 micron particle size; Momentive Silicones The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid, cleaning and/or cleansing composition comprising abrasive cleaning particles, wherein said abrasive cleaning particles comprise a divinyl benzene cross-linked styrene polymer, wherein said abrasive cleaning particles are non-spherical and have a mean particle size D(v,0.9) of at least about 10 μm and wherein said liquid, cleaning and/or cleansing composition comprises from about 1% to about 20% by weight of the composition of an organic solvent, from about 65% to about 99.5% by weight of the total composition of water, from about 0.1% to about 5% by weight of the total composition of a suspending aid, and from about 0.01% to about 20% by weight of the total composition of a surfactant, wherein the particles have a mean circularity of from about 0.1 to about 0.45 and a Equivalent Circle Diameter of from about 50 μm to about 500 μm.

2. A liquid, cleaning and/or cleansing composition according to claim 1, wherein said liquid, cleaning and/or cleansing composition is a household hard surface cleaning composition.

3. A liquid, cleaning and/or cleansing composition according to claim 1, wherein said abrasive cleaning particles comprising a covalently cross-linked copolymer of styrene-co-divinyl benzene are obtained from a foam and reduced to abrasive cleaning particles preferably via a grinding and/or milling.

4. A liquid, cleaning and/or cleansing composition according to claim 1, comprising from about 0.1% to about 20%, preferably from about 0.1% to about 10%, more preferably from about 0.5% to about 5%, even more preferably from about 0.5% to about 2%, by weight of the total composition of said abrasive cleaning particles.

5. A liquid, cleaning and/or cleansing composition according to claim 1, wherein said non-spherical particles have sharp edges and each particle has at least one edge or surface having concave curvature.

6. A liquid, cleaning and/or cleansing composition according to claim 1, wherein said abrasive cleaning particles herein have a Form Factor (FF) of below about 0.75, preferably below about 0.6, most preferably below about 0.50.

7. A liquid, cleaning and/or cleansing composition according to claim 1, wherein said abrasive cleaning particles herein have a mean particle size D(v,0.9) of from about 10 μm to about 1000 μm, preferably from about 10 μm to about 100 μm, more preferably from about 10 μm to about 50 μm.

8. A liquid, cleaning and/or cleansing composition according to claim 1, wherein said abrasive cleaning particles have a mean Equivalent Circle Diameter ECD of from 100 μm to 350 μm and preferably from 150 μm to 250 μm.

9. A liquid, cleaning and/or cleansing composition according to claim 1, wherein said abrasive cleaning particles comprise about 100% by weight of the total particle of the styrene-co-divinyl benzene copolymer.

10. A liquid, cleaning and/or cleansing composition according to claim 1, wherein said abrasive cleaning particles comprise about 10 to about 80% by weight of the total particle of the styrene-co-divinyl benzene copolymer.

11. A liquid, cleaning and/or cleansing composition according to claim 1, wherein said abrasive cleaning particles are obtained by reducing, preferably by grinding and/or milling, a foam obtained through a polymerized water/oil High Internal Phase Emulsion (HIPE) of water in the styrene and divinyl benzene monomer mixture.

12. A method of cleaning and/or cleansing a surface with a liquid, cleaning and/or cleansing composition according to claim 1, wherein said surface is contacted with said composition, preferably wherein said composition is applied onto said surface.

13. A method according to claim 12, wherein said surface is an inanimate surface, preferably selected from the group consisting of: household hard surfaces; dish surfaces; fabric surfaces especially leather or synthetic leather; and automotive vehicle surfaces.

14. A method according to claim 12, wherein said surface is an animate surface, preferably selected from the group consisting of: human skin; animal skin; human hair; animal hair; and human skin; and hard and soft tissue surface of the oral cavity, preferably teeth, gums, tongue and buccal surfaces.

15. A method according to claim 12, wherein said surface is a household hard surface.

16. A liquid, cleaning and/or cleansing composition comprising abrasive cleaning particles, wherein said abrasive cleaning particles comprise a divinyl benzene cross-linked styrene polymer, wherein said abrasive cleaning particles are non-spherical and have a mean Equivalent Circle Diameter ECD of at least 10 μm (preferably from 10 μm to 1000 μm, more preferably from 50 μm to 500 μm, even more preferably from 100 μm to 350 μm and most preferably from 150 to 250 μm) and wherein said liquid, cleaning and/or cleansing composition comprises from 1% to 20% by weight of the composition of an organic solvent, from about 65% to about 99.5% by weight of the total composition of water, from about 0.1% to about 5% by weight of the total composition of a suspending aid, and from about 0.01% to about 20% by weight of the total composition of a surfactant, wherein the particles have a mean circularity of from about 0.1 to about 0.45 and the polymer comprises from about 40% to about 60% of styrene.

17. A liquid, cleaning and/or cleansing composition according to claim 16, wherein said abrasive cleaning particles comprising a covalently cross-linked copolymer of styrene-co-divinyl benzene are obtained from a foam and reduced to abrasive cleaning particles preferably via grinding and/or milling.

18. A liquid, cleaning and/or cleansing composition according to claim 16, comprising from 0.1% to 20%, preferably from 0.1% to 10%, more preferably from 0.5% to 5%, even more preferably from 0.5% to 2%, by weight of the total composition of said abrasive cleaning particles.

19. A liquid, cleaning and/or cleansing composition according to claim 16, wherein said non-spherical particles have sharp edges and each particle has at least one edge or surface having concave curvature.

20. A liquid, cleaning and/or cleansing composition according to claim 16, wherein said abrasive cleaning particles herein have a Form Factor (FF) of below 0.75, preferably below 0.6, most preferably below 0.50.

21. A liquid, cleaning and/or cleansing composition according to claim 16, wherein said abrasive cleaning particles comprise 100% by weight of the total particle of the styrene-co-divinyl benzene copolymer.

22. A liquid, cleaning and/or cleansing composition according to claim 16, wherein said abrasive cleaning particles comprise 10 to 80% by weight of the total particle of the styrene-co-divinyl benzene copolymer.

23. A liquid, cleaning and/or cleansing composition according to claim 16, wherein said abrasive cleaning particles are obtained by reducing, preferably by grinding and/or milling, a foam obtained through a polymerized water/oil High Internal Phase Emulsion (HIPE) of water in the styrene and divinyl benzene monomer mixture.

24. A method of cleaning and/or cleansing a surface with a liquid, cleaning and/or cleansing composition according claim 16, wherein said surface is contacted with said composition, preferably wherein said composition is applied onto said surface.

* * * * *